US005821023A

United States Patent [19]

Shibuya et al.

[11] Patent Number: 5,821,023

[45] Date of Patent: Oct. 13, 1998

[54] DEVELOPER OF ELECTROSTATIC LATENT IMAGE, CARRIER THEREFOR, METHOD FOR FORMING IMAGE AND IMAGE FORMING APPARATUS THEREBY

[75] Inventors: Yuusaku Shibuya; Yasuhiro Oya; Haruhide Ishida; Susumu Yoshino; Hirokazu Hamano; Kaori Ohishi; Satoshi Inoue; Jun Igarashi; Chiaki Suzuki; Sueko Sakai, all of Minami-ashigara, Japan

[73] Assignee: Fuji Xerox Co., Ltd., Tokyo, Japan

[21] Appl. No.: 862,701

[22] Filed: May 23, 1997

[30] Foreign Application Priority Data

| | | | |
|---|---|---|---|
| May 27, 1996 | [JP] | Japan | 8-132423 |
| May 28, 1996 | [JP] | Japan | 8-133706 |
| May 29, 1996 | [JP] | Japan | 8-135593 |
| May 29, 1996 | [JP] | Japan | 8-135594 |

[51] Int. Cl.[6] ..... G03G 9/113; G03G 15/08; G03G 13/08

[52] U.S. Cl. ..... 430/108; 430/120; 399/225

[58] Field of Search ..... 430/108, 120

[56] References Cited

U.S. PATENT DOCUMENTS

| | | | |
|---|---|---|---|
| 5,028,568 | 7/1991 | Anderson et al. | 501/12 |
| 5,649,197 | 7/1997 | Fujita | 399/260 |

FOREIGN PATENT DOCUMENTS

| | | | |
|---|---|---|---|
| A-52-30437 | 3/1977 | Japan . | |
| A-53-121627 | 10/1978 | Japan . | |
| A-54-92244 | 7/1979 | Japan . | |
| A-57-79961 | 5/1982 | Japan . | |
| A-59-52255 | 3/1984 | Japan . | |
| A-60-23884 | 2/1985 | Japan . | |
| A-60-112052 | 6/1985 | Japan . | |
| A-60-186844 | 9/1985 | Japan . | |
| A-60-238847 | 11/1985 | Japan . | |
| A-61-80161 | 4/1986 | Japan . | |
| A-61-80162 | 4/1986 | Japan . | |
| A-61-80163 | 4/1986 | Japan . | |
| B2-63-60904 | 11/1988 | Japan . | |
| A-64-13560 | 1/1989 | Japan . | |
| A-1-105264 | 4/1989 | Japan . | |
| A-1-118150 | 5/1989 | Japan . | |
| A-2-79862 | 3/1990 | Japan . | |
| 2-158754 | 6/1990 | Japan | 430/108 |
| B2-2-27664 | 6/1990 | Japan . | |
| 3-65963 | 3/1991 | Japan | 430/108 |
| A-3-137048 | 6/1991 | Japan . | |
| A-3-213878 | 9/1991 | Japan . | |
| A-4-40607 | 2/1992 | Japan . | |
| A-4-268573 | 9/1992 | Japan . | |
| A-6-118724 | 4/1994 | Japan . | |

*Primary Examiner*—Roland Martin
*Attorney, Agent, or Firm*—Oliff & Berridge, PLC

[57] ABSTRACT

The present invention provides a long-life carrier for developing an electrostatic latent image to be used in such field of applications as electrostatic photography and electrostatic recording, a developer of an electrostatic latent image utilizing said carrier, a method for forming an image and an image forming apparatus by using said developer. By use of the foregoing qualities, a high-quality image can be obtained.

30 Claims, 3 Drawing Sheets

DEVELOPER OF ELECTROSTATIC LATENT IMAGE, CARRIER THEREFOR, METHOD FOR FORMING IMAGE AND IMAGE FORMING APPARATUS THEREBY

BACKGROUND OF THE INVENTION

1. Field of the Invention

The present invention relates to a developer of an electrostatic latent image, a carrier therefor in electrostatic photography and electrostatic recording, a method for forming an image and an image forming apparatus thereby.

2. Description of the Related Art

Heretofore, a Carlson process has been generally used for forming an image in a copying machine or a laser beam printer. The Carlson process comprises the steps of imparting an electrostatic charge to a carrying roll for latent image, forming an electrostatic latent image by optically exposing the charged carrying roll, developing the latent image to form a toner image (visible image) by adhering toner to the latent image formed on the carrying roll, transferring the toner image to a recording medium such as paper, and fixing the toner image on the recording medium by such means as heat and pressure. After fixing, the remaining toner is removed by means of a cleaning device from the carrying roll, which is thus put in a standby position for a repetition of the copying operation.

In the above-described process, the image developing process is classified into a one-component method using a toner alone and a two-component method using a toner and a carrier, in terms of the developers employed.

A one-component developer for the one-component developing method is generally composed of a toner prepared by a process comprising melting, blending a binder resin, such as a polystyrene, a styrene/butadiene copolymer and a polyester, with a pigment or dye, such as carbon black and phthalocyanine blue, and pulverizing to result product. A two-component developer for the two-component developing method is generally a mixture of toner with a carrier composed of particles of such materials as glass beads, iron, nickel and ferrite, each having an average particle diameter ranging from a diameter nearly equal to that of the toner up to 500 $\mu$m or with a carrier prepared by coating one of said carrier with a resin.

The carrier of the two-component developer performs the functions such as stirring, transportation and electrostatically charging. Therefore, the two-component developer is superior in that the amount of friction-induced electrostatic charge of the toner can be fairly well controlled by the selection of the characteristics and stirring conditions of the carrier. Finally, the two-component developer enhances the reliability of the image quality. Therefore, a two-component developing method, which utilizes a two-component developer, is now widely employed. Particularly, a two-component developer, which utilizes a resin-coated carrier, is superior in that its charging is better controllable and in that its insusceptibility to environmental influences and its stability over long-time use can be relatively easily improved.

In addition to the above-mentioned cascade process, other known processes include a magnetic brush developing method wherein a magnetic roll is utilized as a developing substrate. Because of the excellence in the reproduction of not only a line image but also of a solid image as well as of a continuous gradation, today the magnetic brush developing method is preferably employed.

However, the magnetic brush developing method, which utilizes a two-component developer, has some disadvantages, for example, the image density decreases and the background is seriously stained due to the deterioration of the chargeability of the developer, a rough image is produced due to the adhesion of the carrier to the image, high consumption of the carrier, and unevenness in the image density.

The deterioration of the chargeability of the developer tends to occur where the toner component adheres (spent) to the resin coating layer of the carrier or where the resin coating layer is peeled off. Further, if the thickness of the resin coating layer becomes ununiform, the fog on the background tends to occur when environmental factors, such as temperature and humidity, vary, when the toner is added, or where the toner concentration is high.

Since a coated carrier is superior to an uncoated carrier in the light of the life of developer, various types of coated carriers have been developed and put to practical uses. Various coated carriers have been proposed to satisfy the following characteristics required in the coated carrier: (i) stably providing a proper chargeability (amount of charge and distribution of charge) to toner; (ii) maintaining the proper and stable charge characteristic for a long period of time. These carriers have proper electrical properties and are not sensitive to changes in environment, such as temperature or humidity, and are resistant to impact and friction. It is also important for the coated carrier not to change the ability of electrostatic charge over a long period of time (long life).

In order to prevent the deterioration of the chargeability of the developer, various attempts have been made, for example, a method wherein the hardness of the coating resin is increased so that the resistance to peeling increases, a method wherein the surface energy of the coating resin is decreased to prevent the adhesion of the toner component to the coating resin layer and a method which comprises a combination thereof. For example, Japanese Patent Application Laid-Open (JP-A) No. 54-92,244 proposes a negative-chargeable carrier utilizing a polyacrylonitrile and an acrylonitrile copolymer to obtain the stability of chargeability and prevent the deterioration of carrier, in which the use of a combination of the negative-chargeable carrier and an epoxy-based positive-chargeable toner is described. According to JP-A No. 54-92, 244, for the purpose of coating a core, acrylonitrile as a monomer is coated onto the surface of the core and thereafter polymerized or otherwise an ABS resin, as a copolymer of acrylonitrile with styrene and butadiene, is dissolved in chloroform and then the solution is coated onto the surface of the core. However, it is difficult to form a uniform and stable resin coating layer by these methods and no long-life carrier is obtained by these methods.

JP-A Nos. 61-80,161, 61-80,162 and 61-80,163 disclose a carrier having a relatively long life which is obtainable by coating the surface of a carrier core with a copolymer comprising nitrogen-containing fluorinated vinyl monomer, more specifically with a copolymer of a nitrogen-containing fluorinated alkyl(meth)acrylate and a vinyl-based monomer or with a copolymer of a fluorinated alkyl(meth)acrylate and a nitrogen-containing vinyl-based monomer.

Further, JP-A No. 1-118,150 discloses a carrier having a relatively hard coating layer which is obtainable by a process comprising coating the carrier core surface with a polyamide resin and hardening the polyamide resin. Furthermore, JP-A No. 2-79,862 discloses a carrier having a relatively hard coating layer which is obtainable by a process comprising coating the carrier core surface with a melamine resin and curing the melamine resin.

However, the above-described coated carriers are not satisfactory, because of adhesion of toner component onto the carrier surface (spent) That is, despite the requirement of a function that a carrier should carry toner and a function that the carrier should impart a charge to the toner for a long period of time in a stable manner, the latter function does not work effectively because the toner is gradually adhered onto the carrier surface.

In order to prevent the adhesion of toner onto the carrier surface, it is effective to use a silicone resin as described in JP-A No. 60-186,844 or to use a fluorine-containing resin as described in JP-A No. 64-13,560. However, the wear resistance of these resins is insufficient. The use of these resins together with the aforementioned polymers or resins to coat a carrier core surface is still insufficient for the long-term prevention of the adhesion of toner onto a carrier, because the upper portion of the coating layer is rich in the silicone resin or fluorine-containing resin, which is lost over long term use of the carrier due to the wear that starts from the surface of the carrier. In short, this technique cannot prevent the adhesion of toner onto the carrier surface during the use of the toner over a long period of time.

Furthermore, JP-A No. 3-213,878 describes a process for producing a long-life coated carrier by coating an acrylic resin containing particles of a crosslinked polymer onto the surface of carrier core to obtain a thicker coating layer so that proper charge characteristic of the carrier will be maintained for a long period of time. However, since the particles of the crosslinked resin swell in an organic solvent due to an insufficient degree of crosslinkage, the expected effect cannot be fully exhibited. That is, the disadvantages of this technique are that, since the particles of the crosslinked resin swell in an organic solvent at the stage where the surface of carrier core is coated, the removal of the solvent by distillation requires a longer time, so that the coated layer is not uniform because of volume contraction at the time of removal of the solvent. Accordingly, this technique based on the carrier utilizing the particles cannot provide a sufficient level of charge characteristic and therefore a long-life carrier cannot be obtained.

Although the above-described techniques are characterized by the selection of the employable resins, JP-A No. 1-105,264 discloses a technique which is still based on the selection of a resin to be used for a carrier but which does not limit the resin to a specified one. The technique is based on a carrier having a coating layer containing a plurality of resins, which are mutually immiscible, and electroconductive particles. This technique, however, cannot satisfactorily solve the above-mentioned problems.

Accordingly, the object of the first invention is to provide a carrier, which has a long life and overcomes the problem of the adhesion of toner onto the carrier surface.

A toner image obtained by a developing treatment is transferred to an image receiving sheet, such as paper, and a fixed image is formed by melt-adhesion of the transferred toner image utilizing a fixation device, which is generally exemplified by a heating roller system. A fixation device according to the heating roller system consists of a heating roller equipped with a heating source and a pressing roller so that the fixation is performed by passing the toner image so that the toner image is press-contacted with the surface of the heating roller. Therefore, the toner employable needs to have a low-temperature fixability in order to meet the requirement of energy saving and adaptation to a high speed, although the press-contact between the toner image on the image receiving sheet and the surface of the heating roller provides the advantage that the thermal efficiency is very high and the fixation is rapid.

An example of a toner excellent in low-temperature fixability is the toner utilizing a polyester resin as a binder. Since a polyester resin having a high glass transition point and yet a low softening point can be easily obtained, the use of such polyester resin makes it possible to facilitate the wetting of the image receiving sheet, such as paper, with the molten resin and to perform the fixation at a lower temperature. However, it has been difficult to provide a wide range of fixable temperatures by use of a conventional polyester resin, because some of the conventional polyester resins tend to result in the disadvantage that, at a relatively low temperature, part of a toner image adheres to the heating roller to such an extent that a stain-creating offset phenomenon occurs on an adjacent image receiving sheet.

In order to overcome this drawback, Japanese Patent Application Publication (JP-B) No. 63-60,904 discloses a type of toner utilizing as a binder resin a polyester resin which comprises a component produced from a polyfunctional monomer having at least tri-functionality and which has a content of chloroform-insoluble matters in the range of 5 to 25% by weight. However, a toner utilizing such a polyester resin as a binder resin is susceptible to changes in environmental conditions, particularly at high temperature and high humidity. Under such conditions adverse effects on the maintenance of the charge characteristics of the toner are seen. In order to solve the disadvantage, increasing the amount of the coating resin layer on the carrier enhances the amount of initial electrostatic charge and reduces the susceptibility to the change in environmental conditions. However, the increase in the amount of the coated-resin layer on the carrier leads to a higher electric resistance of the developer with the result that the image quality may become inferior.

Therefore, the object of the second invention is to obtain a developer for an electrostatic latent image, which developer has a fixability for a wide range of temperatures and which is less susceptible to changes in environmental conditions and has a very long life, and provides an image forming method to obtain a high-quality image by use of said developer.

Meanwhile, in order to prolong the life of a developer by preventing the adhesion of toner to the carrier surface, the toner is often admixed with an additive. Examples of the additive include particles of an hydrophobic silica (JP-A No. 52-30,437), a mixture of particles of an hydrophobic silica and particles of aluminum oxide or titanium oxide (JP-A No. 60-23,884), wherein titanium oxide is produced by a vapor-phase process and hydrophobically treated (JP-A No. 59-52,255), anatase titanium oxide (JP-A No. 60-112,052) and titanium oxide coated with aluminum oxide (JP-A No. 57-79,961). Another example is titanium oxide particles which are surface treated with a coupling agent (JP-A Nos. 4-40,607 and 3-137,048). Also, surface processing of inorganic compounds used as additives has been proposed.

However, the mere addition of an additive alone to toner cannot impart satisfactory properties to the toner. For example, although the addition of hydrophobic silica particles, which is often employed, considerably improves such properties as storage stability, carriability, developability and transferability, use of the hydrophobic silica in an amount sufficient for improving these properties adversely affects the chargeability of the toner to an extent that the amount of the charge increases as the copying operations are repeated. That is, with regard to the charging characteristics, the developer must satisfy such requirements as amount of charge, speed of charging, distribution of amounts of charge, admixability of toner, and charge stability against changes in environmental conditions. However, the use of the silica adversely affects the speed of electrostatic charging, distribution of amounts of charge, admixability of toner, and charge stability with respect to changes in environmental conditions.

In the case where rutile or anatase titanium oxide is used as an additive, the titanium oxide needs to be coated with alumina or the like or otherwise needs to be hydrophobically treated with a coupling agent or the like, because untreated titanium oxide is substantially electrically uncharged. The alumina-treated titanium oxide has the problem that it does not necessarily have superior resistance to aggregation of the particles and the dispersibility of these particles in the toner is inferior. On the other hand, the titanium oxide hydrophobically treated with a coupling agent cannot be practically used, because it is not satisfactory in that, where it is singly used, the amount of initial electrostatic charge becomes too small and toner scattering occurs, although it is somewhat effective in the improvement of chargeability.

A developer admixed with a combination of a hydrophobic silica and a hydrophobic titanium oxide in a predetermined blending ratio (1:5 to 1:1) is also proposed to utilize the advantage of each of them (JP-B No. 2-27,664), but such a combination is not satisfactory because the amount of electrostatic charge is excessively increased by the hydrophobic silica.

Accordingly, the object of the third invention is to provide a developer characterized by its chargeability resistance to changes in temperature and humidity which is well maintained by use of a long-life carrier used for developing electrostatic latent images and that its use results in a high-quality image.

The aforementioned developing apparatus by means of magnetic brushing comprises a latent image carrying roll, a developer carrying roll, which is positioned in the vicinity of the latent image carrying roll, an auger for stirring a developer and toner to be added as required and a controlling member for regulating the thickness of the layer of the developer on the developer carrying roll so that the amount to be carried into the developing zone is controlled, wherein the surface of the latent image on the latent image carrying roll is brought into sliding contact with the developer which rises in the shape of a brush by means of the magnetic force on the developer carrying roll, i.e., a magnetic brush.

The above-mentioned sliding contact involves the contact and collision between the toner and carrier, which naturally damages both toner and carrier. Examples of the damages include the embedding of a surface additive into the toner and loss of toner components for the toner, and the adhesion of toner components, including additives, onto the carrier surface for the carrier. If the carrier is a resin-coated carrier, the sliding contact causes wear and tear of the coating layer. As a result, the repetitive use of a developer loses the initial performance of the developer and causes such defects as fog on the background, stains inside the copying machine and fluctuation in the density of image.

In order to maintain a stabilized quality level of a developer during repetitive use, it is necessary to minimize any damage to the toner and carrier. For this purpose, it is necessary to minimize the impacting force at the time of contact and collision between the toner and carrier by decreasing the circumferential speed ratio of the developer carrying roll to the latent image carrying roll.

Meanwhile, the present inventors have found that the toner is given an electrostatic charge by friction in the upstream side of the layer regulating zone (pre-nip region) in the developing device and on the developer carrying roll after passage through the gap (nip region) between the layer regulating member and the developer carrying roll.

In the pre-nip region, the develop carrying roll brings in the developer in an amount at least larger than the amount that passes through the nip region and therefore the developer is divided into two portions; namely, the portion which passes through the nip region and the portion which cannot pass through the nip portion. The portion, which cannot pass through the nip portion, dwells in the pre-nip region for a while in the form of "stagnant pool". During the dwell time of the developer, the developer remaining in the pre-nip region is blended with the fresh incoming developer by means of stirring, which imparts electrostatic charge to the toner by way of friction. Since the aforementioned sliding contact also imparts electrostatic charge to the toner by way of friction, these frictional charging phenomena add to the frictional charging by means of the auger to maintain the amount of the electrostatic charge of the toner at a desired level.

In order to minimize the impacting force at the time of contact and collision between the toner and carrier, the reduction of the circumferential speed ratio of the developer carrying roll to the latent image carrying roll will cause insufficient frictional charging on the developer carrying roll so that toner cannot obtain a proper amount of electrostatic charge.

Therefore, there is a demand for an image forming method and an image forming apparatus which can fulfill the conflicting requirements that the mechanical damages to the toner and carrier be reduced and that a proper amount of electrostatic charge be obtained rapidly even from a weak level of contact and collision, without the loss of other desirable properties of the toner.

Accordingly, an object of the fourth invention is to provide an image forming method and an image forming apparatus which causes less damage to the developer.

Another object of the fourth invention is to provide an image forming method and an image forming apparatus, which are excellent in the optimization of the amount of the electrostatic charge or stabilization of toner and have no adverse influence on other properties of the toner in the repetitive use of a copying machine.

SUMMARY OF THE INVENTION

The object of the present invention is to provide a carrier for developing an electrostatic latent image, which carrier is capable of preventing the adhesion of toner onto the carrier surface, a developer of an electrostatic latent image utilizing toner and said carrier, a method for forming an image and an image forming apparatus utilizing said developer.

The object can be achieved by a carrier for developing an electrostatic latent image, comprising a core covered with a resin coating layer containing fine particles of a resin dispersed in a matrix resin. Further, the object can be achieved by a developer of an electrostatic latent image, comprising the carrier and toner, as well as by a method for forming an image and an image forming apparatus utilizing the developer.

An object of the first invention of the present inventions, is to provide a carrier for developing an electrostatic latent image, which carrier has a very long life and overcomes the problem of the adhesion of toner onto the carrier surface for a long period of time.

Another object of the first invention is to provide a developer of an electrostatic latent image by use of the above-mentioned carrier.

A further object of the first invention is to provide an image forming method capable of forming a high-quality image by use of the above-mentioned carrier.

A still further object of the first invention is to provide an image forming apparatus using the above-mentioned carrier as an element.

The object of the second invention of the present inventions is to obtain a developer for an electrostatic latent image, which has a fixability for a wide range of temperatures and which is less susceptible to changes in environmental conditions and has a very long life, and to provide a high-quality image forming method by use of the developer.

The object of the third invention of the present inventions is to provide a developer characterized by its stability of chargeability despite variations in temperature and humidity. The said developer is well maintained by the incorporation of a very long-life carrier for developing electrostatic latent images and that its use results in a high-quality image.

The object of the fourth invention of the present inventions is to provide an image forming method and an image forming apparatus which do little damage to the developer.

Another object of the fourth invention is to provide an image forming method and an image forming apparatus which are superior in the optimization of the amount of the electrostatic charge or stabilization of toner and have no adverse influence on other properties of the toner in the repetitive use of a copying machine.

The object of the first invention can be achieved in the following way.

1)-1 The object of the first invention can be achieved with a carrier for a developer of an electrostatic latent image comprising a core covered with a resin coating layer containing fine particles of a thermosetting resin dispersed in a matrix resin, wherein the fine particles of a thermosetting resin have a critical surface tension of not less than 20 dyn/cm.

More specifically, the other object of the first invention can also be achieved in the following way:

1)-2 The carrier according to 1)-1, wherein the thermosetting resin particles have average particle diameter in the range of 0.1 to 2 μm;

1)-3 The carrier according to 1)-1, wherein the thermosetting resin particles are composed of a resin containing a nitrogen atom;

1)-4 The carrier according to 1)-1, wherein the resin coating layer has an average thickness in the range of 0.1 to 10 μm;

1)-5 The carrier according to 1)-1, wherein the matrix resin has a critical surface tension of not greater than 35 dyn/cm;

1)-6 The carrier according to 1)-1, wherein the carrier has an average diameter of primary particles thereof in the range of 30 to 150 μm;

1)-7 The carrier according to 1)-1, wherein the average diameter (B) of primary particles of the resin particles meets the requirement of (B)≦(A), where (A) represents the average thickness of the resin coating layer;

1)-8 The carrier according to 1)-1, wherein the shape factors SF1 and SF2 are represented by the general equations (1) and (2) and meet the requirements represented by the equations (x) and (y);

$$SF1=(\text{maximum diameter})^2\times 100\pi/4 \quad (1)$$

$$SF2=(\text{circumferential length of a projected image})^2\times 100/4\pi \quad (2)$$

$$100\leqq SF1\leqq 145 \quad (x)$$

$$100\leqq SF2\leqq 120 \quad (y)$$

1)-9 A developer of an electrostatic latent image, comprising the carrier according to 1)-1 and a toner;

1)-10 The developer according to 1)-9, wherein the toner has an average particle diameter in the range of 3 to 9 μm;

1)-11 The developer according to 1)-9, wherein the toner comprises a binder resin which includes a linear polyester;

1)-12 An image forming method comprising developing a latent image on a latent image substrate by providing a developer layer containing the developer according to 1)-9 on a developing substrate; and 1)-13 An image forming apparatus comprising developing a latent image on a latent image substrate by providing a developer layer containing the developer according to 1)-9 on a developing substrate.

In the carrier of the first invention, the resin coating layer comprises components different from each other in construction, i.e., a matrix resin and fine particles of a specific thermosetting resin. For this reason it becomes possible to enhance the stabilized capability to provide electrostatic charge and prevent the adhesion of toner onto the carrier mainly by the function of the matrix resin and to enhance the mechanical strength by the function of the fine particles of a specific thermosetting resin. Accordingly, it is possible to exhibit the stabilized capability to provide electrostatic charge, mechanical strength and prevent the adhesion of toner onto the carrier over a long period of time.

In addition, the fine particles of a thermosetting resin having a specific critical surface tension, are easily dispersed in the matrix resin and perform the above-mentioned functions in a stable manner. Further, the uniform dispersion enables the carrier to maintain a surface constitution equivalent to unused one even if the use thereof over a long time wears the surface of the coating layer.

Furthermore, since the fine particles of a thermosetting resin do not swell in an organic solvent at the time of manufacture of the carrier, ununiformity of the coating layer due to change in volume does not take place.

The object of the second invention can be achieved in the following way:

2)-1 The object of the second invention can be achieved through a developer of an electrostatic latent image, wherein the developer comprises a carrier and toner, which carrier comprises a core covered with a resin coating layer containing resin particles and an electroconductive material dispersed in a matrix resin, wherein the toner comprises a binder resin and a colorant, wherein binder resin has a content of THF-insoluble matters in the range of 1 to 25% by weight based on 100% by weight of the binder resin.

More details are give below in order to achieve the other object of the second invention:

2)-2 The developer according to 2)-1, wherein the binder resin comprises a polyester resin which has a content of THF-insoluble matters in the range of 5 to 30% by weight based on 100% by weight of the polyester resin;

2)-3 The developer according to 2)-1, wherein the resin particles have an average particle diameter in the range of 0.1 to 2 μm;

2)-4 The developer according to 2)-1, wherein the resin particles comprises a resin which contains a nitrogen atom;

2)-5 The developer according to 2)-1, wherein the resin particles are melamine resin particles;

2)-6 The developer according to 2)-1, wherein the electroconductive material is carbon black;

2)-7 The developer according to 2)-1, wherein the toner has an average particle diameter in the range of 3 to 10 μm;

2)-8 The developer according to 2)-1, wherein the critical surface tension of the matrix resin is not greater than 35 dyn/cm;

2)-9 The developer according to 2)-1 , wherein the carrier has an average particle diameter in the range of 10 to 50 μm; and 2)-10 An image forming method comprising developing a latent image on a latent image substrate by providing a developer layer containing the developer according to 2)-1 on a developing substrate.

As described above, the present inventors have succeeded in providing a toner which has a fixability for a wide range of temperatures and is superior in fixability at a lower temperature and in offset resistance. Further, they have succeeded in improving the insusceptibility of toner to changes in environmental conditions, in particular the preservation of electrostatic charge at high temperatures and high humidities, by use of a carrier coated with a resin layer containing resin particles, in particular resin particles of a nitrogen-containing resin represented by a melamine resin, and particles of an electroconductive material. Accordingly, the present inventors have succeeded in providing a developer of an electrostatic latent image, which developer maintains an excellent capability to provide electrostatic charge during continuous use over a long period of time, and an image forming method utilizing the developer.

The object of the third invention can be achieved in the following way:

3)-1 The object of the first invention can be achieved with a developer of an electrostatic latent image comprising toner containing a binder resin and a colorant along with a carrier comprising a core covered with a resin coating layer, wherein the toner is admixed, with respect to 100 parts by weight of the toner, with 0.05–2.0 parts by weight of a hydrophobic silica (surface-treated with a silicone oil and 0.05–2.0 parts by weight of a surface-treated titanium dioxide) and the resin coating layer containing fine particles of a thermosetting resin dispersed in a matrix resin.

More details are give below in order to achieve the object of the third invention:

3)-2 The developer according to 3)-1, wherein the critical surface tension of the fine particles of a thermosetting resin is not less than 20 dyn/cm;

3)-3 The developer according to 3)-1, wherein the weight ratio of silica to titanium dioxide is in the range of 1:5.5 to 1: 20;

3)-4 The developer according to 3)-1, wherein the thermosetting resin particles have an average particle diameter in the range of 0.1 to 2 μm;

3)-7 The developer according to 3)-1, wherein the thermosetting resin particles are composed of a resin containing a nitrogen atom;

3)-6 The developer according to 3)-1, wherein the amount of the resin coating layer is in the range of 0.5 to 5 parts by weight based on 100 parts by weight of the core;

3)-7 The developer according to 3)-1, wherein the carrier has an average particle diameter in the range of 30 to 100 μm;

3)-8 The developer according to 3)-1, wherein the titanium dioxide is treated with a silane coupling agent;.

3)-9 The developer according to 3)-1, wherein the amount of the silane coupling agent is in the range of 2 to 50 parts by weight based on 100 parts by weight of the titanium dioxide;

3)-10 The developer according to 3)-1, wherein the toner has an average particle diameter in the range of 5 to 12 μm;

3)-11 An image forming method comprising developing a latent image on a latent image substrate by providing a developer layer containing the developer of 3)-1 on a developing substrate; and 3)-12 An image forming method comprising developing a latent image on a latent image substrate by providing a developer layer containing the developer of 3)-2 on a developing substrate.

As described above, according to the developer of an electrostatic latent image of the third invention, it is possible to provide a developer which has the chargeability made less susceptive to the change in temperature and humidity, and which better maintains this excellent property as a result of the use of a long-life carrier for the developer and which produces a high-quality image.

The object of the fourth invention can be achieved in the following way:

4)-1 The object of the fourth invention can be achieved with an image forming method comprising developing an electrostatic latent image on an electrostatic latent image substrate by providing a layer of a developer on a developing substrate, wherein the developing substrate and the electrostatic latent image substrate move in the same direction in such a manner that a circumferential speed ratio of the developing substrate to the electrostatic latent image substrate is in the range of 0.5 to 1.8 and wherein the developer comprises a carrier and toner, which carrier comprises a core covered with a resin coating layer containing resin particles dispersed in a matrix resin.

More specifically, the other object of the first invention can also be achieved in the following way:

4)-2 The image forming method of 4)-1, wherein the resin particles are fine particles of a thermosetting resin;

4)-3 The image forming method of 4)-1, wherein the resin particles are fine particles of a crosslinkable resin;

4)-4 The image forming method of 4)-1, wherein the resin particles are composed of a resin containing a nitrogen atom;

4)-5 The image forming method of 4)-1, wherein the amount of the resin coating layer is in the range of 0.05 to 5 parts by weight based on 100 parts by weight of the core;

4)-6 The image forming method of 4)-1, wherein the critical surface tension of the matrix resin is not greater than 35 dyn/cm;

4)-7 The image forming method of 4)-1, wherein the core of the carrier has an average diameter in the range of 30 to 100 μm;

4)-8 The image forming method of 4)-1, wherein the toner is a color toner;

4)-9 The image forming method of 4)-1, wherein the toner comprises a linear polyester as a binder resin; and 4)-10 An image forming apparatus for developing an electrostatic latent image on an electrostatic latent image substrate by providing a layer of a developer on a developing substrate, wherein the developing substrate and the electrostatic latent image substrate move in the same direction in such a manner that a circumferential speed ratio of the developing substrate to the electrostatic latent image substrate is in the range of 0.5 to 1.8 and wherein the developing substrate holds the developer comprising a resin-coated carrier and toner, which resin-coated carrier comprises a core covered with a resin coating layer containing resin particles dispersed in a matrix resin.

According to the image forming method and image forming apparatus of the fourth invention, it is possible to improve the electrostatic charging speed of the toner particles, to obtain a narrow range of charge distribution and to maintain a stabilized amount of the charge even after use of the toner over a long period of time so that a stabilized quality of copied image can be obtained. The developer has the chargeability made less susceptive to changes in temperature and humidity, and better maintains this excellent property as a result of the use of a long-life carrier for the developer and therefore always produces a high-quality image.

Figure 1:
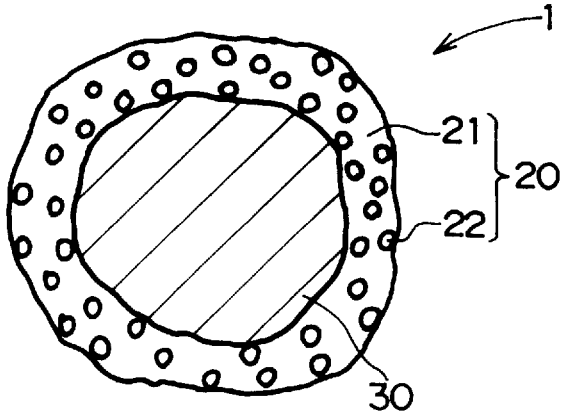
FIG. 1 is a schematic diagram illustrating an embodiment of a carrier according to the present invention.

The carrier 1 has a core 30 and a resin coating layer 20 thereon. The resin coating layer 20 contains resin particles 22 which have a specific physical property and are dispersed in a matrix resin 21. The resin particles 22 according to the first invention are preferably particles of a thermosetting resin.

Figure 2:
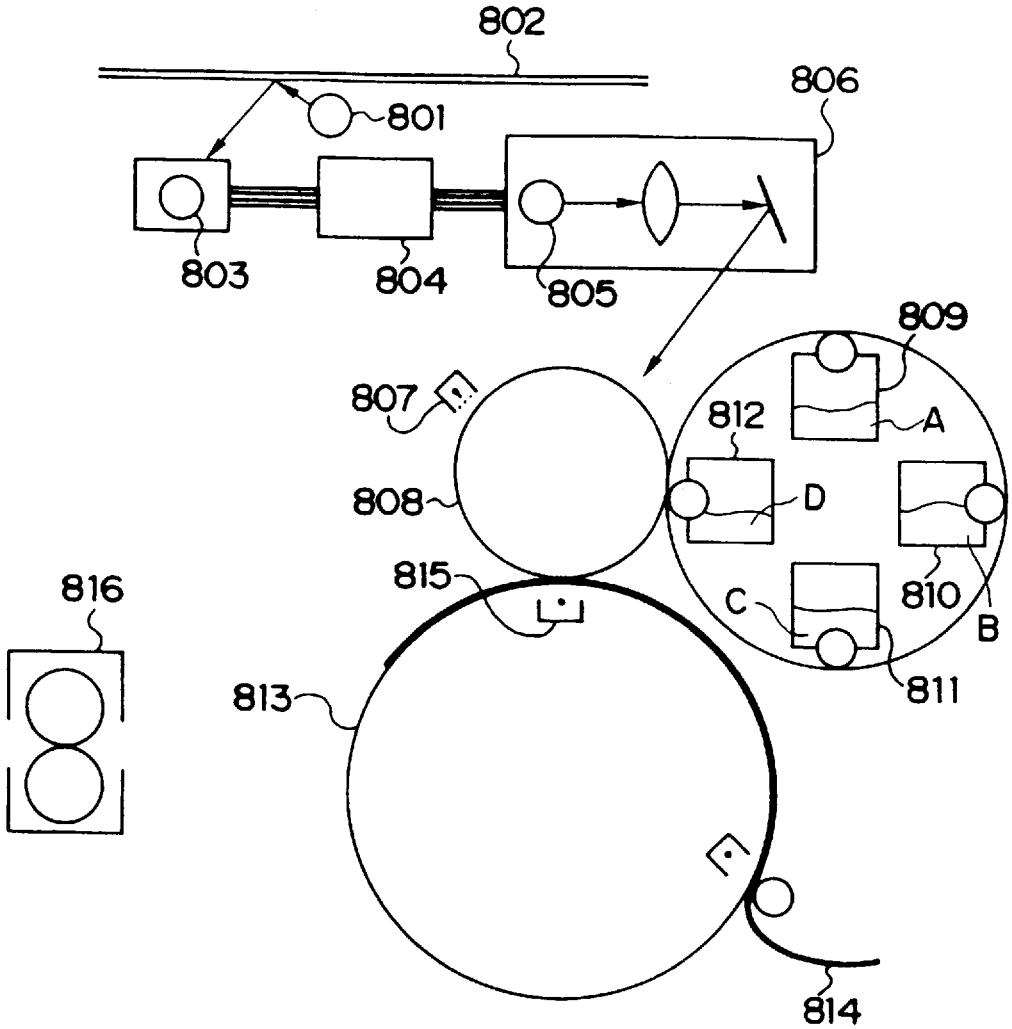

FIG. 2 is a schematic diagram illustrating an embodiment of an image forming apparatus according to the present invention.

By use of the developer of the present invention and the above-mentioned apparatus, an image can be formed. According to this apparatus, an original 802 is irradiated with the light from an illuminator 801. The reflected light is detected by a color CCD 803 and is fed to an image processor unit 804, which separates the light into three colors of Y, M and C. Each color is image-processed and outputted from a semiconductor laser 805 in the form of light signals in succession, in which the angle between the closest pixels varies for each of the colors. The output light signals are passed through an optical system 806 to a photoreceptor 808 which is electrically charged by means of a charger 807 to thereby form an electrostatic latent image in such a manner that an image region has a lower potential. Developing units 809–812 are filled with developers A, B, C and D which are electrostatically charged and comprise color toners and carriers obtained according to the procedures described hereinbefore. The development is conducted by attracting the color toners to the photoreceptor by means of an electrostatic force by applying development bias.

The toners after development are transferred to a paper 814, which is caused to adhere to a transfer drum 813 by means of an electrostatic force, one color after another, utilizing the electric field which is provided by a transfer corotron 815. This procedure is repeated three times in the order of Y, M and C to form, on the transfer paper, a colored toner image comprising a three-color superposition, followed by the thermal fixation by the use of a fixing unit 816, to form a colored image.

Figure 3:
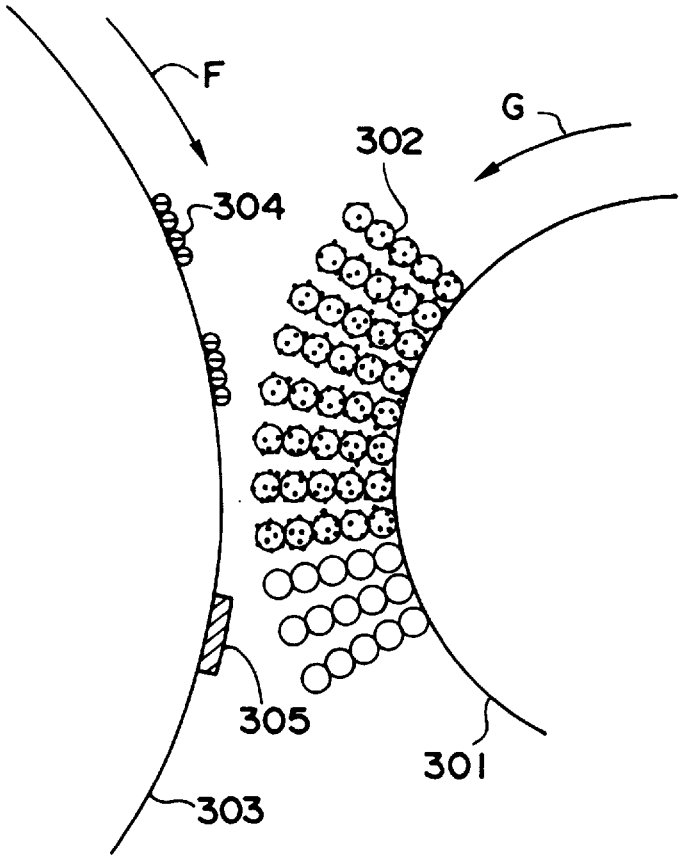

FIG. 3 is a schematic diagram illustrating an embodiment of the process of an image forming method and an image forming apparatus according to the fourth invention.

As illustrated in FIG. 3, the image forming apparatus according to the fourth invention comprises a photoreceptor roll 303 as a substrate for an electrostatic latent image rotatable in the direction indicated by an arrow F (clockwise), a charger (not shown), such as a corona charger, which electrically charges the photoreceptor roll 303, an exposing means (not shown) for the exposure of the charged photoreceptor roll 303, a magnetic brush developing unit, a transferring means (not shown) for the transfer of the toner image on the photoreceptor roll 303 to an image receiving medium, a fixing means (not shown) for the fixation of the image on the image receiving medium and a cleaning means (not shown) for the removal of the toner remaining on the photoreceptor roll 303. The magnetic brush developing unit comprises a fixed magnet in the inside thereof, a developer carrying roll 301 as a developing substrate rotatable in the direction indicated by an arrow G (counterclockwise), a doctor blade (not shown), which is positioned upstream to the developing zone formed between the developer carrying roll 301 and the photoreceptor roll 303 but in the vicinity of the developer carrying roll 301, a toner feeder (not shown) and an auger (not shown) for stirring the developer. According to this image forming apparatus, a toner image 305 is formed by developing an electrostatic latent image 304 held on the photoreceptor roll 303 by the layer of developer 302 (a layer created by the magnetic brush) held on the developer carrying roll 301.

In this image forming apparatus, the developer carrying roll 301 and the photoreceptor roll 303 move in the same direction in the developing zone. This mechanism prevents the formation of a streak-shaped abnormal image and produces an image superior to the image produced in the case where the developer carrying roll 301 and the photoreceptor roll 303 move in an opposite direction in the developing zone.

DESCRIPTION OF THE PREFERRED EMBODIMENTS

The present invention is described in detail below by way of embodiments in the order of the first, second, third and fourth invention.

FIG. 1 illustrates an embodiment of a carrier for developing an electrostatic latent image according to the first invention.

Preferably, the thermosetting resin particles are dispersed in the matrix resin as uniformly as possible both in the direction of the thickness of the coating layer and in the direction of a line tangent to the surface of the carrier. At the same time, preferably the matrix resin of the coating layer is also uniform in the same manner. This configuration of the coating layer enables the entire carrier to provide a charge and to prevent toner from being adhered onto the carrier in a uniform and stable manner. Further, the configuration makes it possible to maintain these functions for a long period of time, because the surface composition of the coating layer can be always maintained even if the coating layer is worn from the surface thereof during use over a long time.

Preferably, the resin particles to be dispersed in the resin coating layer are particles of a thermosetting resin in the first invention, since the particles of a thermosetting resin can increase the hardness and durability of a carrier without swelling in an organic solvent to be used upon manufacturing. The thermosetting resin needs to have a critical surface tension of not less 20 dyn/cm, because this characteristic is necessary for the fine particles of the thermosetting resin to have an excellent stability of dispersion in a matrix resin and the fine particles to be uniformly dispersed in the matrix. In this respect, the critical surface tension is preferably in the range of 40 to 70 dyn/cm.

Examples of the thermosetting resins, which fulfill the requirement for the critical surface tension of not less than 20 dyn/cm and are employable in the first invention, include phenolic resins; amino resins, such as a urea/formaldehyde resin, melamine resins, benzoguanamine resins, urea resins, polyamide resins; epoxy resins; dially phthalate resins, unsaturated polyester resins; polyimide resins; alkyd resins; xylene resins; petroleum resins; furan resins and the like. One kind or two or more kinds of resin particles may be used. Alternatively, individual particle of the resin particles may be composed of one resin or two or more resins of the above examples.

Further, in order to impart a negative electrostatic charge to a toner, it is preferred that the resin particles contain a nitrogen atom to form a structural component having an electron donating characteristic.

Although the resin particles may be produced by any suitable method, the following methods may be used for the production of the crosslinked resin particles:

The methods include a method in which a granular resin is produced by the utilization of a polymerization process such as suspension polymerization or emulsion polymerization; a method in which a monomer or an oligomer is dispersed in a poor solvent and particles are formed by the action of surface tension during a crosslinking reaction; and a method in which a component having a low molecular weight and a crosslinking agent are molten and mixed with each other to cause a reaction between them and then the reaction product is finely divided to a predetermined particle size by means of wind force or a mechanical force.

Prior to the mixing and dispersing the resin particles into a carrier resin, the resin particles are preferably in a state of desired fineness, which makes it easier to realize and confirm a uniform dispersion.

The average particle diameter of the resin primary particles according to the first invention is preferably 0.1 to 2 $\mu$m, more preferably 0.2 to 1 $\mu$m. If the average particle diameter is less than 0.1 $\mu$m, the level of dispersion in a coating layer becomes extremely poor, whereas, if the average particle diameter is greater than 2 $\mu$m, the particles tend to be separated from the coating layer, which makes it impossible to maintain the inherent function of the particles.

The average film thickness of the resin coating layer formed in the above-described manner is normally in the range of 0.1 to 10 $\mu$m, preferably in the range of 0.2 to 3 $\mu$m. The average film thickness of the resin coating layer can easily be calculated according to the following equation, where $\rho_D$ is the specific gravity of a core material for carrier, D is the average particle diameter of the core material for carrier, $\rho_C$ is the average specific gravity of coated resins including the resin particles and $W_C$ is the total weight of the coated resins.

Film thickness (A) = [weight of coated resins (including resin particles) per one carrier / surface area per one carrier] ÷ average specific gravity of coated resins $$= [\tfrac{4}{3}\pi \cdot (D/2)^3 \cdot \rho_D \cdot W_c] / [4\pi \cdot (D/2)^2] \div \rho_C$$

$$= (1/6) \cdot (D \cdot \rho_D \cdot W_C / \rho_C)$$

In a particularly preferred embodiment of the carrier according to the first invention, the average diameter (B) of primary particles of a thermosetting resin meets the requirement of (B)≦(A) where (A) represents the average thickness of the resin coating layer. If average diameter of primary particles is greater than the thickness of the resin coating layer, some of the resin particles are not sufficiently embedded into the coating layer. The resin particles, which are not sufficiently embedded into the coating layer, are easily separated by a relatively small external force and may not fully perform the expected function to impart electrostatic charge to a toner, and, in addition, tend to be ununiformly distributed on the carrier surface due to the external mechanical force created at the time when the resin coating layer is formed with the result that the surface composition of the resin coating layer becomes ununiform to broaden the range of toner charge distribution thereby producing the fluctuation in the density of copied image and fog.

Based on the above-described viewpoint, a more preferred requirement is (B)≦0.8 (A) and most preferred requirement is (B)≦0.5 (A).

In the first invention, the number-based particle diameter distribution of the crosslinked particles is preferably controlled within a certain range. More specifically, the proportion of particles having particle diameters of not greater than $\frac{1}{2}\times d_{50}$ is not greater than 20 percent by number and the proportion of particles having particle diameters of not less than $2\times d_{50}$ is not greater than 20 percent by number. Here, $d_{50}$ means a number average particle diameter. If the proportion of particles having particle diameters of not greater than $\frac{1}{2}\times d_{50}$ is greater than 20 percent by number, a large number of aggregation of smaller particles lower the uniformity of the composition of the coating layer. Further, the charge characteristic of the toner by contact becomes unstable. On the other hand, if the proportion of particles having particle diameters of not less than $2\times d_{50}$ is greater than 20 percent by number, the stability is impaired because the particles tend to be separated from the coating layer, since the characteristic of imparting charge to toner changes with time as developer is used.

In the first invention, the particle diameter distribution is based on the values measured in the following way. The particles are observed by a scanning electron microscope and a photograph is taken at a magnification of 5,000. Then, after binary processing of hydrophobic inorganic particles and colored particles in the photograph by means of an image analyzer, a number-based particle diameter distribution is obtained from about 100 of randomly chosen hydrophobic inorganic particles based on a diameter corresponding to a circle. In this case, the hydrophobic inorganic particle is counted as one unit so long as the particle is capable of behaving as a unit particle, irrespective of the state of the particle, namely a primary particle or a secondary particle. Further, in the first invention, "number average particle diameter" means a particle diameter at a percentage which corresponds to a cumulative number of particles of 50 percent of the total number in a particle diameter distribution. And, it is generally called median diameter.

In the first invention, the total amount of the resin particles in the resin coating layer is normally 1 to 50 percent by volume, preferably 5 to 30 percent by volume, and more preferably 5 to 20 percent by volume.

A matrix resin, which contains the above-described resin particles, may be selected from any of resins which can be used as a coating layer of carrier in the art. These resins can be used alone or in a combination of two or more.

Examples of these resins include polyolefinic resins such as polyethylene and polypropylene; polyvinyl resins and polyvinylidene resins such as polystyrene, acrylic resins, polyacrylonitrile, polyvinyl acetate, polyvinyl alcohol, polyvinyl butyral, polyvinyl chloride, polyvinyl carbazole, polyvinyl ether and polyvinyl ketone; vinylchloride/vinylacetate copolymers; styrene/acrylic acid copolymers; straight silicone resins containing organosiloxane linkages or modified products thereof; fluorine-containing resins such as polytrifluoroethylene, polytetrafluoroethylene, polyhexafluoroethylene, polyvinyl fluoride, polyvinylidene fluoride and polychlorotrifluoroethylene; polyester; polycarbonate; phenolic resins; amino resins such as a urea/formaldehyde resin, melamine resins, benzoguanamine resins, urea resins and polyamide resins; epoxy resins; and the like.

In a carrier for a developer of an electrostatic latent image in the first invention, a matrix resin has a critical surface tension ($\gamma c$) preferably of not greater than 35 dyn/cm and more preferably of not greater than 30 dyn/cm. By using such matrix resin, the surface energy is reduced to a level that prevents the toner from being adhered to the surface of the carrier.

Examples of the resin having a critical surface tension of not greater than 35 dyn/cm are as follows:

Polystyrene ($\gamma c$=33 dyn/cm), polyethylene ($\gamma c$=31 dyn/cm), polyvinyl fluoride ($\gamma c$=28 dyn/cm), polyvinylidene fluoride ($\gamma c$=25 dyn/cm), polytrifluoroethylene ($\gamma c$=22 dyn/cm), polytetrafluoroethylene ($\gamma c$=18 dyn/cm), polyhexafluoropropylene ($\gamma c$=16 dyn/cm), and the like. Other usable resins are, for example, a copolymer of vinylidene fluoride with an acrylic monomer, a copolymer of vinylidene fluoride with vinyl fluoride and a fluoroterpolymer such as a terpolymer of tetrafluoroethylene/vinylidene fluoride/unfluorinated monomer.

Particularly suitable as the matrix resin is a resin or polymer having a critical surface tension of 30 dyn/cm or less, exemplified by a fluorine-containing resin or polymer and/or a silicone resin.

The matrix resin and the particulate resin may be of the same kind if these resins can be classified into each type in accordance with their manufacturing processes, molecular weights and the like.

In the carrier of the first invention, the kinds and manufacturing processes of the carrier, to be coated with the above-described resins, are not particularly limited and those employed in the art can be used. Examples of the material for the carrier include magnetic metals such as iron, steel, nickel and cobalt, magnetic oxides such as ferrite and magnetite, glass beads, and the like. The material for the carrier is preferably a magnetic material, because a magnetic carrier is desired for the utilization of a magnetic brush. Ferrite, the saturation magnetization of which is not too high and the specific gravity of which is relatively small, is preferred, because the mechanical stress to be created on the toner will be slight.

Ferrite, as an example of a core material of a carrier in the first invention, is generally produced in the following way: As a starting material, metal oxide powders are prepared with particles sizes of not greater than 10 $\mu$m and their molar ratio adjusted to $Fe_2O_3$:MgO:ZnO:$MnO_2$:CuO=50:25:20:1:4. The metal oxides are mixed by means of a mixer such as a Henschel mixer and are subjected to a calcination at 900° C. for 3 hours in a kiln to obtain a semi-spinel-type powder. The resulting powder is mixed with water and is subjected to grinding in a ball mill for 10 hours. The resulting aqueous dispersion is admixed with a binder (polyvinyl alcohol) and a dispersant in an amount of a few weight percent to obtain a slurry. The slurry is dried and granulated to obtain pellets, which are calcined at 1,300° C. for 4 hours in an electric furnace to obtain ferrite consisting of primary particles having a suitable particle size. The thus obtained ferrite is subjected to a sieving operation to remove coarse particles and undesirably fine particles. In this manner, core particles, which have a desired particle size and electric conductivity, can be obtained.

The crystal growth of primary particles during calcining forms cavities on the joining faces of the primary particles. The proportion of the cavity formation has an influence on the shape factors and is controlled by such conditions as the properties of the starting materials, additives, calcining conditions and pulverizing conditions.

The average particle diameter of the carrier core is generally in the range of 10 to 150 $\mu$m, preferably of 30 to 100 $\mu$m.

In a particularly preferred embodiment of the carrier in the first invention, the shape factors of core SF1 and SF2 are represented by the general equations (1) and (2) and meet the requirements represented by the equations (x) and (y).

$$SF1=(\text{maximum diameter})^2\times 100\ \pi/4 \quad (1)$$

$$SF2=(\text{circumferential length of a projected image})^2\times 100/4\pi \quad (2)$$

$$100\leqq SF1\leqq 145 \quad (x)$$

$$100\leqq SF2\leqq 120 \quad (y)$$

The above-defined shape factors are used as a factor expressing the morphology such as the shape of the carrier core material. These factors are based on a statistic method, namely, an image analysis which enables a quantitative analysis in a highly precise manner of the area, length, shape and the like of an image obtained by such means as an optical microscope. And, these factors can be measured by means of an image analyzer (model "RUZEX 5000" manufactured by Nippon Regulator Co., Ltd.).

As is apparent from equation (1), SF1 is a numerical value obtained from the square of the maximum diameter of a particle of the carrier core forming particles, divided by the area of the particle, multiplied by $\pi/4$ and further multiplied by 100. Therefore, SF1 approaches 100 as the shape of a carrier core material approaches a sphere. Conversely, SF1 takes a larger value as the shape of a carrier core material becomes longer and narrower. Accordingly, SF1 indicates the difference between the maximum diameter and the minimum diameter, namely, a strain.

As is apparent from the equation (2), SF2 is a numerical value obtained from the square of the circumferential length of the projected image of a particle of the carrier core forming particles, divided by the area of the particle, multiplied by $\frac{1}{4}\pi$ and further multiplied by 100. Therefore, SF2 approaches 100 as the shape of a carrier core material approaches a sphere. Conversely, SF2 takes a larger value as the shape of a carrier core material becomes complicated. Accordingly, SF2 indicates the surface area (surface roughness) of a particle of the carrier core forming particles. If the particle is a perfect sphere, SF1=SF2 =100 is obtained.

If SF1 satisfies the equation (x) and SF2 satisfies the equation (y), it becomes possible to form a uniform film when coating the carrier core, to obtain a narrow range of distribution of the charge of the toner and to maintain a stabilized charge imparting characteristic because the toner impaction is reduced.

In the carrier for developing an electrostatic latent image in the first invention, a typical method for forming the above-mentioned resin coating layer on the surface of a core is the utilization of a solution for forming a resin coating layer (containing at least a matrix solution, and resin particles in a solvent) . Preferred examples of the method are an immersion method wherein a core material powder is immersed in a solution for forming a coating layer, a spray method wherein a solution for forming a coating layer is sprayed on the surface of a core material, a fluidized bed method wherein a solution for forming a coating layer is sprayed on a core powder which is floated by means of fluidizing air and a kneader coater method wherein a core powder and a solution for forming a coating layer are blended in a kneader and thereafter the solvent is removed. The kneader coater method is particularly preferable in the first invention.

A solvent to be used in a solution for forming coating layer is not particularly limited so far as the solvent dissolves a matrix resin. Examples of the solvent are aromatic hydrocarbons such as toluene and xylene; ketones such as acetone and methyl ethyl ketone; and ethers such as tetrahydrofuran and dioxane.

Since the resin particles are already desirably in a particulate state in a solvent, the resin particles are preferably substantially insoluble in the solvent. Owing to this insolubility, the resin particles can be kept as primary particles without aggregating in the resin coating layer.

If the resin particles are uniformly dispersed in a solvent, the particles can be uniformly dispersed in the resin coating layer to be formed. Therefore, it is preferred to prepare a solution for forming a coating layer in which the resin particles are uniformly dispersed. By the use of such a solution, uniform dispersion is very easily attainable. For example, a uniform dispersion can be obtained if the entire solution is churned.

The carrier for the developer of an electrostatic latent image in the first invention is used together with any suitable type of granular toner to form a developer of an electrostatic latent image.

The toner contains a colorant and a binder resin. These ingredients are not particularly limited. Typical examples of the colorant are carbon black, nigrosin, aniline blue, calcoyl blue, chrome yellow, ultramarine blue, Dupont oil red, quinoline yellow, methylene blue chloride, phthalocyanine blue, malachite green oxalate, lamp black, rose bengal, C. I. Pigment Red 48:1, C. I. Pigment Red 122, C. I. Pigment Red 57:1, C. I. Pigment Yellow 97, C. I. Pigment Yellow 12, C. I. Pigment Blue 15:1, C. I. Pigment Blue 15:3, and the like.

Examples of the binder resins include homopolymers or copolymers, which are made up of styrenes such as styrene and chlorostyrene; monoolefins such as ethylene, propylene, butylene and isoprene; vinyl esters such as vinyl acetate, vinyl propionate, vinyl benzoate and vinyl acetate; esters of an $\alpha$ -methylene aliphatic monocarboxylates such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers such as vinyl methyl ether, vinyl ethyl ether and vinyl butyl ether; vinyl ketones such as vinyl methyl ketone, vinyl hexyl ketone and vinyl isopropenyl ketone; and the like. Typical examples of the binder resins are polystyrenes, styrene/alkyl acrylate copolymers, styrene/alkyl methacrylate copolymers, styrene/acrylonitrile copolymers, styrene/butadiene copolymers, styrene/maleic anhydride copolymers, polyethylene and polypropylene. Other examples include polyesters, polyurethanes, epoxy resins, silicone resins, polyamides, modified rosins, paraffin and wax. Among the foregoing binder resins, particularly advantageous are polyesters. For example, linear polyester resins comprising polycondensation products, in which bisphenol A and an aromatic polycarboxylic acid are contained as primary monomeric substances, can preferably be used.

A particularly preferred resin is one which has a softening point of 90° to 150° C., a glass transition point of 50 to 70° C., a number average molecular weight of 2,000 to 6,000, a weight average molecular weight of 8,000 to 150,000, an acid value of 5 to 30 and a hydroxyl value of 5 to 40.

If desired, the above-mentioned toner particles may be admixed with a known additive such as a charge controlling agent or a fixation aid.

By use of the carrier and the developer according to the first invention described above, an image can be formed utilizing, for example, an apparatus illustrated in FIG. 2. According to this apparatus, an original 802 is irradiated with the light from an illuminator 801. The reflected light is read by a color CCD 803 and is fed to an image processor unit 804, which separates the light into three colors of Y, M and C. Each color is image-processed and outputted from a semiconductor laser 805 in the form of light signals in succession, in which the angle between the closest pixels varies for each of the colors. The output light signals are passed through an optical system 806 to a photoreceptor 808 which has been electrically charged by means of a charger 807 to thereby form an electrostatic latent image in such a manner that an image region has a lower potential. Developing units 809–812 are filled with developers A, B, C and D which are electrostatically charged and comprise color toners and carriers obtained according to the procedures described hereinbefore. The development is conducted by attracting the color toners to the photoreceptor by means of an electrostatic force by applying development bias.

The toners after development are transferred to a paper 814, which is caused to adhere to a transfer drum 813 by means of an electrostatic force, one color after another, utilizing the electric field which is provided by a transfer corotron 815. This procedure is repeated three times in the order of Y, M and C to form, on the transfer paper, a colored toner image comprising a three-color superposition, followed by the fixing thermally by the use of a fixing unit 816, to form a colored image.

The second invention is explained below.

The toner, which is used in the developer of electrostatic latent image (hereinafter sometimes simply referred to as developer in the second invention), is described below. The toner of the second invention contains a binder resin and a colorant and is required to have the content of THF-insoluble matters in the range of 1 to 25% by weight, preferably 3 to 20% by weight, based on 100% by weight of the binder resin.

Toner, which has a content of THF-insoluble matters in a proportion less than 1% by weight, does not exhibit a sufficient offset resistance, whereas toner, which has a content of THF-insoluble matters in a proportion more than 25% by weight, exhibits poor results in fixation. The content of THF-insoluble matters, as mentioned above, indicates the THF-insoluble matters per 100% by weight of the binder resin excluding other additives, such as colorant and releasing agent, from the toner.

The content of THF-insoluble matters of the binder resin in the second invention means the amount of the matters which do not pass through filter paper, when a THF (tetrahydrofuran) solution of a sample is filtered by means of the filter paper. The content of THF-insoluble matters of the binder resin can be obtained in the following procedure:

(1) A sample of 200–300 mg is directly weighed into a 25 ml Erlenmeyer flask and then 20 ml of THF is placed in the Erlenmeyer flask. The contents are left to stand overnight;.

(2) The contents of the Erlenmeyer flask are transferred into a Teflon tube for centrifugal separation;

(3) The Erlenmeyer flask of (1) is rinsed out with 20 ml of THF, which is thereafter added to the aforementioned tube for centrifugal separation to obtain a total volume of 40 ml. Then, the tube is hermetically sealed with "SEALON" film (trade name: from Fuji Photo Film Co., Ltd.);

(4) The tube for centrifugal separation is subjected to a centrifugal separating operation under a condition of 18,000 rpm at −10° C. for 20 minutes;

(5) The tube for centrifugal separation is taken out and is left to stand until the tube reaches room temperature;

(6)-5 ml of the supernatant solution of the tube for centrifugal separation is taken out and is placed on an aluminum dish which has been weighed in advance. Then, the solvent THF is evaporated by means of a hot plate;

(7) The aluminum dish containing the sample is placed in a vacuum drying apparatus held at 50° C. overnight. Then, the aluminum dish, including the thus-dried sample as THF-soluble matters in the 5 ml solution, is weighed; and (8) The content of THF-insoluble matter is calculated according to the following equation:

{<weight of sample>) − [(<THF-soluble matters + weight of aluminum dish> − <weight of aluminum dish>) × 40/5]} ÷ <weight of sample> × 100 = THF-insoluble matters (%).

Since the toner contains additives such as colorant and releasing agent in addition to the binder resin, the contents of these additives need to be subtracted when calculating the content of THF-insoluble matter of the binder resin.

Examples of the binder resin for the toner in the second invention include polystyrenes, styrene/alkyl acrylate copolymers, styrene/alkyl methacrylate copolymers, styrene/acrylonitrile copolymers, styrene/butadiene copolymers, styrene/maleic anhydride copolymers, polybutadiene, polypropylene and the like. Other examples include polyesters, polyurethanes, epoxy resins, polyamides, modified rosins, paraffin and wax. Among the foregoing binder resins, particularly advantageous are polyesters having a content of THF-insoluble matters in the range of 5 to 30% by weight. Examples of the preferred polyester resins include those obtained from polyhydroxy compounds and polycarboxylic acids or reactive derivatives thereof such as lower alkyl esters, acid anhydrides and acid halides. Examples of the polyhydroxy compounds include dihydroxy compounds, namely, polyethylene glycols such diethylene glycol, propylene glycol, 1,4 -butanediol, 2,3-butanediol, 1,5-pentanediol, 1,6-hexanediol, neopentylene glycol, 1,4-cyclohexanedimethanol, diethylene glycol and triethylene glycol; polypropylene glycols such as dipropylene glycol and tripropylene glycol; bisphenol A and derivatives thereof; bisphenol A/alkylene oxide adducts and hydrogenated bisphenol A, as well as trihydroxy or higher hydroxy-functional compounds such as glycerin, sorbitol, 1,4-sorbitan and trimethylolpropane.

Examples of the polycarboxylic acids include malonic acid, succinic acid, glutaric acid, 1,2,5-hexanetricarboxylic acid, 1,2,7,8-octenetetracraboxylic acid, n-octylsuccinic acid, 1,3-dicarboxy-2-methyl-2-carboxymethylpropane, tetra(carboxymethyl)methane, maleic acid, fumaric acid, dodecenylsuccinic acid, 1,2,4-cyclohexanetricarboxylic acid, phthalic aid, isophthalic acid, terephthalic acid, tirmellitic acid, pyromellitic acid and 1,2,4-naphthalenetricarboxylic acid.

Tg of the binder resin for toner of the second invention is preferably in the range of 50° to 70° C. The polyester resin for toner of the second invention has a content of THF-insoluble matters in the range of 5 to 30% by weight, preferably 10 to 25% by weight, based on 100% by weight of the polyester resin. If a polyester resin which has a content of THF-insoluble matters of less than 5% by weight is used, the obtained toner does not have a sufficient offset resistance, whereas if a polyester resin, which has a content of THF-insoluble matter of more than 30% by weight, is used, the obtained toner has a softening point too high for obtaining fixability and toner productivity such as suitability to pulverization is impaired.

Any known colorants can be used as a colorant for toner particles to be used in the second invention. For example, usable colorants in the second invention may be the same as the colorants for the toner of the first invention.

In the case where the toner of the second invention is used as a magnetic toner, the usable magnetic powders may be known magnetic powders, examples of which include metals, such as iron, cobalt and nickel and alloys thereof, metal oxides, such as $Fe_3O_4$, $\gamma$-$Fe_2O_3$ and cobalt-containing iron oxide, MnZn ferrite, mangetite and hematite, as well as any of the foregoing compounds treated with a silane coupling agent or a titanium coupling agent. Any of these magnetic powders, generally in an amount of 2 to 50% by weight, may be incorporated into the toner.

In the second invention, for the purposes of controlling electrostatic charge, electric resistance and the like, additives may be added to the binder of the toner. Examples of these additives include a fluorine-containing surfactant, salicylic acid, chromium-based dyes such as a chromium complex, charge controlling resins such as copolymers containing, as a monomer component thereof, maleic acid, a vinyl monomer containing an amino group or the like, quaternary ammonium salts and azine-based dyes such as nigrosin.

Furthermore, in the second invention, for the purpose of further improving the offset resistance, releasing agents may be added to the binder of the toner. Examples of these releasing agents include polyolefins or paraffin wax such as polyethylene having a low molecular weight and polypropylene having a low molecular weight, natural wax such as candelilla wax, carnauba wax and montan wax, and derivatives thereof.

In the second invention, toner particles can be admixed with at least one finely divided inorganic compound. Examples of the finely divide inorganic compound include $SiO_2$, $TiO_2$, $Al_2\mathbf{0}_3$, CuO, ZnO, $SnO_2$, $CeO_2$, $Fe_2O_3$, MgO, BaO, CaO, $K_2\mathbf{0}$, $Na_2O$, $ZrO_2$, $CaO.SiO_2$, $K_2O.(TiO_2)_n$, $Al_2O_3$ .2 $SiO_2$, $CaCO_3$, $MgCO_3$, $BaSO_4$ and $MgSO_4$ as well as any of the foregoing compounds treated with a resin or a coupling agent. From the standpoint of enhancing fluidity and resistance to aggregation, the use of $SiO_2$, preferably the one having a particle size of less than 16 nm, is advantageous.

The average particle diameter of the toner for use in the second invention is preferably in the range of 3 to 10 μm, more preferably 5 to 9 μm.

A carrier, which is used in combination with the above-mentioned toner for the preparation of the developer of electrostatic latent image in the second invention, is explained below. The carrier of the second invention has a core and a resin coating layer thereon. The resin coating layer contains resin particles and an electroconductive material which are both dispersed in a matrix resin.

Although any of thermoplastic resin particles and thermosetting resin particles can be used as the resin particles in the second invention, the resin particles are preferably thermosetting resin particles, because the hardness of the thermosetting resin particles can be relatively easily increased and the thermosetting resin particles do not swell in an organic solvent.

Examples of the thermosetting resins, which are employable as resin particles in the second invention, include phenolic resins, epoxy resins, dially phthalate resins, unsaturated polyester resins, polyimide resins, melamine resins, silicone resins, urea resins, alkyd resins and benzoguanamine resins. Further, in order to impart a negative electrostatic charge to toner, it is preferred that the resin particles contain a nitrogen atom to form a structural component having an electron donating characteristic. Accordingly, such resins as melamine resins and benzoguanamine resins are preferred. One kind or two or more kinds of resin particles may be used. Alternatively, individual particle of the resin particles may be composed of one resin or two or more resins of the above examples.

These resin particles can be prepared in the same way as that for preparing the thermosetting resin particles in the first invention.

In the second invention, the incorporated amount of the resin particles is preferably in the range of 5 to 50% by weight, particularly 5 to 30% by weight, based on the total resins in the coating layer. The resin particles in an amount of less than 5% by weight cannot impart a sufficient amount of electrostatic charge to the toner, whereas if the amount of the resin particles is more than 50% by weight, the resin particles tend to separate from the carrier surface.

In the configuration of the carrier to be used in the second invention, the resin particles are uniformly dispersed in the direction of the thickness of the coating layer and also in the direction of a line tangent to the surface of the carrier. At the same time, the matrix resin of the coating layer is also uniform. Owing to this configuration, since the surface composition of the coating layer equivalent to unused one can be always maintained even if the coating layer is worn from the surface thereof during use for a long time period, it is possible to maintain a satisfactory capability to impart an electrostatic charge to the toner. Accordingly, the combination of the above-mentioned resin particles with a specific toner in the second invention makes it possible to better maintain the electrostatic charge of the toner, particularly at high temperature and humidity, and to provide a long-life developer superior in fixability.

The resin particles in the second invention has a particle diameter preferably in the range of 0.1 to 2 μm, more preferably 0.2 to 1 μm. In the case where the average diameter is less than 0.1 μm, the dispersibility of the resin particles in the coating layer is very poor, whereas in the case where the average diameter is greater than 2 μm, the expected function of the resin particles cannot be maintained because the resin particles tend to separate from the coating layer.

The matrix resin for the resin coating layer may be composed of one resin or may be composed of two or more resins.

Examples of the matrix resin in the second invention may be the same as those of the matrix resin in the first invention.

In the construction of the carrier to be used in the developer of an electrostatic latent image in the second invention, preferably a resin having a low surface energy is used in order to prevent the contamination of the carrier surface.

That is, the matrix resin is composed preferably of a resin having a low surface energy of 35 dyn/cm or less, more preferably 30 dyn/cm or less.

Examples of resins, which produce a surface having a low surface energy of a critical surface tension of 35 dyn/cm or less, include the same as those in the first invention. Other resins having a critical surface tension of 35 dyn/cm or less may also be used.

It is particularly preferred that the matrix resin comprise a fluorine-containing resin, polymer and/or a silicone resin having a critical surface tension of 30 dyn/cm or less.

Examples of the materials, which are used as a metal powder and carrier core in the second invention, may be those material for metal powder and carrier core in the first invention. Preferably, the materials for metal powder and carrier core in the second invention are also magnetic substances, because a magnetic carrier is desired for the utilization of a magnetic brush. The average particle diameter of the carrier core is generally in the range of 10 to 150 μm, preferably of 30 to 100 μm.

As for the method for forming a coating layer, which contains the above-mentioned resin particles and matrix resin, on the surface of a core, the same methods as those described in the first invention can be used in the second invention. The kneader coater method is particularly preferable in the second invention, too.

As for the solvent for a solution for forming a coating layer, the solvents described in the first invention can be used.

The coated amount of the resin coating layer in the second invention is normally in the range of 0.01 to 10% by weight, preferably 0.5 to 5% by weight.

For the purpose of improving the reproduction of a solid image in the second invention, it is preferred that an electroconductive fine powder be dispersed in the resin coating layer. This is because as the resin coating layer is formed, a carrier is insulated and does not efficiently serve as an electrode for development purpose so that an adverse effect such as inferior reproduction of a solid image, namely, emergence of an edge effect in a black solid region, in particular, arises.

Examples of the inorganic materials for electroconductive fine powder in the second invention are a metal such as gold, silver or copper, carbon black, a semiconductive oxide such as titanium oxide or zinc oxide, and a coated powder such as titanium oxide, zinc oxide, barium sulfate, aluminum borate or potassium titanate, coated with a material such as tin oxide, carbon black or a metal.

Carbon black is preferred from the standpoint of stability in production, low cost and high electroconductivity. The type of carbon black is not restricted and known types can be used. Particularly preferred is a type of carbon black which has an oil absorption value in the range of 50 to 300 ml/g when measured using dibutyl phthalate and which has an excellent stability in production.

The average particle diameter of the carrier in the second invention is preferably in the range of 10 to 150 μm, more preferably 30 to 100 μm.

The details of the third invention are explained below.

The developer of an electrostatic latent image in the third invention also comprises a toner and a carrier. The toner comprises a binder resin and colorant, wherein the colorant is dispersed in the binder resin.

Examples of the binder resin for the toner in the third invention may be the same as the binder resins described in the first invention. Typical binder resins include polystyrenes, styrene/alkyl acrylate copolymers, styrene/alkyl methacrylate copolymers, styrene/acrylonitrile copolymers, styrene/butadiene copolymers, styrene/maleic anhydride copolymers, polyethylene and polypropylene. Other examples include polyesters, polyurethanes, epoxy resins, silicone resins, polyamides and modified rosins.

Among the foregoing binder resins, particularly advantageous are polyesters. Examples of the preferred polyester resins include those obtained from polyhydroxy compounds and polycarboxylic acids or reactive derivatives thereof such as lower alkyl esters, acid anhydrides and acid halides.

Any known colorants can be used as a colorant in the third invention. For example, usable colorants in the third invention can be the same colorants as those described in the first and second inventions.

The content of the colorant is preferably in the range of 1 to 20 parts by weight based on 100 parts by weight of the binder resin. If the content of the colorant is less than one part, coloring strength is poor, whereas if the content of the colorant is more than 20 parts, the toner fixability is poor.

Also in the third invention, for the purposes of controlling electrostatic charge, electric resistance and the like, the toner may contain, in addition to the binder resin and colorant, other substance as an additive. Examples of these additives include a fluorine-containing surfactant, salicylic acid, chromium-based dyes such as a chromium complex, charge controlling resins, such as copolymers containing as a monomer component thereof maleic acid, a vinyl monomer containing an amino group or the like, quaternary ammonium salts and azine-based dyes such as nigrosin.

Furthermore, also in the third invention, for the purpose of further improving the offset resistance, releasing agents may be added to the binder of the toner. Examples of these releasing agents may be the same as those releasing agents described in the second invention.

Since finer toner produces an image of superior quality, the average particle diameter of the toner in the third invention is preferably in the range of 5 to 12 $\mu$m, preferably of 5 to 10 $\mu$m.

The toner in the third invention contains a silica treated with a silicone oil in order to enhance fluidity, resistance to aggregation and insusceptibility to the change of environmental conditions.

Examples of the silicone oil include dimethylsilicone oil, methyphenylsilicone oil and alkyl-modified silicone oils in which the alkyl group is ethyl, propyl or the like.

The silica is treated, calculated with respect to 100 parts by weight thereof, preferably with 1.0–50.0 parts by weight, more preferably with 5.0–40.0 parts by weight, of the silicone oil. Preferably, the particle diameter of the silica is not greater than 16 nm.

The toner is admixed, calculated with respect to 100 parts by weight thereof, preferably with 0.05–2.0 parts by weight, more preferably with 0.1–1.0 parts by weight, and most preferably with 0.2–0.8 parts by weight, of the silica. If the amount of silica added is less than 0.05 parts by weight, the effect in boosting the amount of electrostatic charge and the fluidity is insignificant, whereas if the amount of the silica is more than 2.0 parts by weight, the image density is undesirably reduced due to the increase in the amount of the electrostatic charge. A silica, which is treated with agents other than a silicone oil, may be used together with the silica treated with a silicone oil.

The toner of the third invention comprises a surface-treated titanium dioxide, in order to make it possible, even under conditions of high temperature and high humidity, while maintaining the amount of electrostatic charge necessary for the developing operation, to narrow the range of the charge distribution of toner by homogenizing the charge on the surface of the toner particles and increasing the charging speed of the toner through the speed up of the charge interchange between toner particles and as a result to markedly alleviate the problem of dependence on environment of the electrostatic charge amount of the toner composition.

The above-mentioned titanium dioxide is obtained by surface-treating the titanium dioxide which has been produced by a wet process and has a content of water-soluble matters of less than 2% by weight.

The wet process referred to in the above indicates a manufacturing process in which a chemical reaction is carried out in a solvent and which is generally classified into a sulfuric acid process and a hydrochloric acid process.

According to the sulfuric acid process, the reaction proceeds in a liquid phase to produce an insoluble hydrous titanium oxide.

$$FeTiO_3+2H_2SO_4 \rightarrow FeSO_4+TiO\ SO_4+2H_2O$$

$$TiOSO_4+2H_2O \rightarrow TiO(OH)_2+2H_2O$$

On the other hand, according to the hydrochloric acid process, titanium tetrachloride is dissolved in water to produce an aqueous solution in hydrochloric acid. Then, the solution is admixed with a strong base such as sodium hydroxide to cause the growth of titanium hydroxide $Ti(OH)_4$, to be deposited.

Both the hydrous titanium oxide and the titanium hydroxide are subjected to a calcining treatment to produce titanium dioxide fine particles.

The water-soluble matters include $K^+$, $Na^+$, $Li^+$, $Mg^{2+}$, $PO_4^-$, $SO_4^-$and $Cl^-$which are contained in a conditioner or a coagulant employed in the manufacturing process. The measuring procedure of water-soluble matters comprises the steps of heating a mixture of 5 g of titanium dioxide and 250 ml of water to boil, filtering the mixture after cooling thereof, heating 100 ml of the filtrate to dryness by evaporation and weighing the residue. The details of the procedure are described in JIS K 5116-1973 {Titanium Dioxide (Pigment)}. The amount of water-soluble matters as described in the third invention is measured in accordance with the above-mentioned JIS procedure, wherein the amount of the residue after evaporation is expressed in a weight percentage to the amount of the original titanium dioxide.

The surface treating agents include a silane coupling agent, a titanate coupling agent, an aluminum coupling agent and the like as well as a silicone oil. However, the use of the silane coupling agent is preferred, because the use of the silane coupling agent leads to a high-quality image with reduced fog owing to the prevention of the decrease in the amount of electrostatic charge and preservation of the charge, hydrophobicity and good charge interchange rate.

Typical examples of the silane coupling agents include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltrimethoxysilane, decyltrimethoxysilane, hexamethyldisilazane, N,O-bis (trimethylsilyl)acetamide, N,N-bis(trimethylsilyl) urea, tert-butyldimethylchlorosilane, vinyltrichlorosilane, vinyltrimethoxysilane, vinyltriethyoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane, and γ-chloropropyltrimethoxysilane.

The titanium dioxide is treated, calculated with respect to 100 parts by weight thereof, preferably with 2–50 parts by weight, more preferably with 10–30 parts by weight, of the silane coupling agent. The amount added of the silane coupling agent of less than 2 parts by weight cannot bring about the effect of the silane coupling agent, whereas if the amount of the silane coupling agent is more than 50 parts by weight, the silane coupling agent tends to separate from the titanium dioxide surface to contaminate the carrier and, in addition, increases the resistance of toner to such an extent that the initial chargeability drops.

The toner is admixed, calculated with respect to 100 parts by weight thereof, preferably with 0.05–2.0 parts by weight, more preferably with 0.5–1.5 parts by weight, and most preferably with 0.7–1.1 parts by weight, of the treated titanium dioxide. If the amount of the treated titanium dioxide added is less than 0.05 parts by weight, the effect in enhancing electrostatic charge exchange is insignificant, whereas if the amount of the treated titanium is more than 2.0 parts by weight, the image deteriorates due to impaction of the carrier.

In the third invention, the toner is admixed with the silica particles and the titanium dioxide particles, wherein the weight ratio of the silica particles to the titanium dioxide particles is predetermined and is in the range of 1:5.5 to 1:20, preferably 1:5.5 to 1:10, and most preferably 1:5.5 to 1:7. If the weight ratio of the titanium dioxide particles is less than 5.5 per one part of the silica particles, the effect of the silica particles is excessive and the amount of electrostatic charge undesirably increases, whereas if the weight ratio of the titanium dioxide particles is more than 20 per one part of the silica particles, the image deteriorates due to impaction of the carrier.

For the purpose of admixing and adhering the silica particles and the titanium dioxide particles to the surface of toner particles, a high-speed mixer may be used. Examples of the high-speed mixer include a Henscher mixer and a V-type blender.

The carrier to be used in the third invention is a resin-coated carrier having a core coated with a resin coating layer, wherein the resin coating layer comprises a matrix resin and particles of a thermosetting resin dispersed in the matrix resin.

In the third invention, the thermosetting resin particles have a critical surface tension preferably of not less than 20 dyn/cm, because this characteristic is necessary for the thermosetting resin particles to have an excellent stability of dispersion in a matrix resin and the particles to be uniformly dispersed in the matrix. In particular, the critical surface tension is preferably in the range of 40 to 70 dyn/cm.

Examples of the thermosetting resins, which are employable as resin particles in the third invention, include phenolic resins, amino resins, such as a urea/formaldehyde resin, melamine resins, benzoguanamine resins, urea resins, polyamide resins, epoxy resins, dially phthalate resins, unsaturated polyester resins, polyimide resins, alkyd resins, xylene resins, petroleum resins and furan resins. These resins may be crosslinked. These thermosetting resin particles may be used alone or in a combination of two or more kinds of them.

Further, in order to impart a negative electrostatic charge to a toner, it is preferred that the resin particles contain a nitrogen atom to form a structural component having an electron donating characteristic. In this connection, for example, a crosslinked or uncrosslinked melamine resin is suitable.

The average particle diameter of the thermosetting resin particles in the third invention is preferably 0.1 to 2 μm, more preferably 0.2 to 1 μm. If the average particle diameter is less than 0.1 μm, the level of dispersion in a coating layer becomes extremely poor, whereas, if the average particle diameter is greater than 2 μm, the particles tend to be separated from the coating layer, which makes it impossible to maintain the inherent function of the particles.

In the third invention, the incorporated amount of the thermosetting resin particles is preferably in the range of 5 to 50% by weight, particularly 5 to 30% by weight, based on the weight of the total resins in the resin coating layer. The thermosetting resin particles in an amount of less than 5% by weight cannot impart a sufficient amount of electric charge to the toner, whereas if the amount of the thermosetting resin particles is more than 50% by weight, the resin particles tend to be separated from the carrier surface.

The thermosetting resin particles may be produced by the same manufacturing processes as those described in the first and second intventions.

It is prefer red t hat the thermosetting resin particle s be uniformly dispersed in the matrix resin so that the surface composition of the coating layer equivalent to the unused one can always be maintained even if the coating layer is worn from the surface thereof during use over a long time period and the capability to impart a charge to toner is maintained.

The matrix resin for the carrier in the third invention may comprise the resins described in the first and second invention. In addition, it may comprise vinylidene fluoride/acrylic monomer copolymers, vinylidene fluoride/vinyl fluoride copolymers, and fluroro-terpolymers such as tetrafluroroethylene/vinylidene fluoride/unfluorinated monomer terpolymers. These resins may be used alone or in a combination of two or more of them. Further, the matrix resin may be the same as or different from the thermosetting resin for resin particles.

The materials, which are used for the carrier core of the third invention, may be the same as those for carrier core of the first and second inventions. Also in the third invention, a magnetic carrier is desirable for a magnetic brush method. The average particle diameter of the carrier core of the third invention is generally in the range of 10 to 500 μm, preferably of 30 to 100 μm.

As for the method for forming a coating layer on the surface of a core, the same methods as those described in the first and second inventions can be used in the third invention. The kneader coater method is particularly preferable in the third invention, too.

As for the solvent for a solution for forming a coating layer, the solvents described in the first and second inventions can be used.

The coated amount of the resin coating layer in the third invention is normally in the range of 0.05 to 10 parts by weight, preferably 0.1 to 5 parts by weight, based on 100 parts by weight of the core material.

In the third invention, for the purpose of improving the reproduction of a solid image, an electroconductive fine powder may be dispersed in the resin coating layer. This is because as the resin coating layer is formed, a carrier is insulated and does not efficiently serve as an electrode for development purpose so that an adverse effect such as inferior reproduction of a solid image, namely, emergence of an edge effect in a black solid region, in particular, arises.

In the third invention, the electroconductive materials described in the second invention can also be used as an electroconductive material. Carbon black is preferred from the standpoint of stability in production, low cost and high electroconductivity. The type of carbon black is not limited and any known types can be used. Particularly preferred is a type of carbon black which has an oil absorption value in the range of 50 to 300 ml/g when measured using dibutyl phthalate and which has excellent stability during production.

The developer having the above-described construction can be applied to an image forming method comprising the steps of imparting an electrostatic charge to a carrying roll for a latent image, forming an electrostatic latent image by exposing the charged carrying roll for the latent image to a light such as a flash lamp, and developing the latent image to a toner image (visible image) by transferring the toner present on a developer carrying roll to the latent image on the roll carrying the latent image.

The details of the fourth invention are explained below.

FIG. 3 is a schematic diagram illustrating an embodiment of the process of an image forming method and an image forming apparatus according to the fourth invention.

As illustrated in FIG. 3, the image forming apparatus according to the fourth invention comprises a photoreceptor roll 303 as a substrate for an electrostatic latent image rotatable in the direction indicated by an arrow F (clockwise), a charger (not shown), such as a corona charger, which electrically charges the photoreceptor roll 303, an exposing means (not shown) for the exposure of the charged photoreceptor 303, a magnetic brush developing unit, a transferring means (not shown) to transfer the toner image on the photoreceptor roll 303 to an image receiving medium, a fixing means (not shown) for the fixation of the image on the image receiving medium and a cleaning means (not shown) for the removal of the toner remaining on the photoreceptor roll 303. The magnetic brush developing unit comprises a fixed magnet in the inside thereof, a developer carrying roll 301 as a developing substrate rotatable in the direction indicated by an arrow G (counterclockwise), a doctor blade (not shown), which is positioned upstream of the developing zone formed between the developer carrying roll 301 and the photoreceptor roll 303 but in the vicinity of the developer carrying roll 301, a toner feeder (not shown) and an auger (not shown) for stirring the developer. According to this image forming apparatus, a toner image 305 is formed by developing an electrostatic latent image 304 held on the photoreceptor roll 303 by the layer of developer 302 (a layer created by the magnetic brush) held on the developer carrying roll 301.

In this image forming apparatus, the developer carrying roll 301 and the photoreceptor roll 303 move in the same direction in the developing zone. This mechanism prevents the formation of a streak-shaped abnormal image and produces an image superior to the image produced in the case where the developer carrying roll 301 and the photoreceptor roll 303 move in an opposite direction in the developing zone.

The amount of the toner, which adheres to the latent image, depends on the relative speed between the circumferential speed of the photoreceptor roll 303 and the developer carrying roll 301. Unlike the conventional circumferential speed ratio of 2.0 or more, the circumferential speed ratio of 0.5–1.8 adopted in the fourth invention makes it possible to reduce the mechanical pressure to be applied to the developer and, as a result, to prolong the life of the developer. In this case, if the circumferential speed ratio is less than 0.5, the carried amount of toner is insufficient and the image density tends to decrease, whereas if the circumferential speed ratio is more than 1.8, the energy of collision increases to such an extent that the life of the toner decreases because the carrier and toner are subject to significant damage. The circumferential speed ratio is preferably in the range of 0.7 and 1.6.

In the above-described image forming apparatus, if a larger amount of toner needs to be carried into the developing zone, an alternating current bias is preferably applied to the developing zone in addition to the direct current bias. The alternating current bias is normally in the range of 1 to 4 kV, preferably 1.4 to 2.5 kV. The frequency is normally in the range of 1 to 10 kHz.

Meanwhile, it may be presumed that, if the circumferential speed ratio of the developer carrying roll 301 to the photoreceptor roll 303 is decreased to a level of 0.5–1.8, the reduction in the mechanical force, namely, the reduction in the charge exchange speed between the toner and the carrier, takes place so that the speed of electrostatically charging the toner, which is freshly supplied into the developing device, is decreased particularly in the case of a continuous operation during a long period of time.

The carrier, which is employed in the fourth invention, is a carrier comprising a core coated with a resin coating layer. The resin coating layer comprises a matrix resin and resin particles dispersed in the matrix resin. Due to the resin particles, the surface roughness of the carrier increases. Since the carrier of the fourth invention has a larger surface area per unit weight of the carrier, the probability of the contact between the carrier and the toner increases so that the charge exchange speed between the toner and the carrier increases, followed by the result that the amount of the electrostatic charge of the toner is brought to a suitable level in a shorter time and the attained charge level is stabilized. Accordingly, the toner charging speed is appropriately maintained. Furthermore, unlike the conventional carrier, the surface area of which diminishes due to wear during use over a long period of time, the carrier of the fourth invention can maintain the surface composition of the coating layer equivalent to unused even if the coating layer is worn from the surface thereof during use and maintain a satisfactory capability to impart a charge to toner.

As described in the above, according to the fourth invention, it is possible to fulfill the requirements, namely, the prolongation of the life of the developer and the stability in the amount of electrostatic charge together with the stable image formation without fog, without adversely affecting other properties.

In the fourth invention, any of thermoplastic resin particles, thermosetting resin particles and crosslinked resin particles can be used as the resin particles. Among them, thermosetting resin particles having a relatively high level of hardness are particularly preferred.

Examples of the thermoplastic resins, which are used for the resin particles in the fourth invention, include polyolefinic resins such as polyethylene and polypropylene; polyvinyl resins and polyvinylidene resins such as polystyrene, acrylic resins, polyacrylonitrile, polyvinyl acetate, polyvinyl alcohol, polyvinyl butyral, polyvinyl chloride, polyvinyl carbazole, polyvinyl ether and polyvinyl ketone; vinylchloride/vinylacetate copolymers; styrene/acrylic acid copolymers; fluorine-containing resins such as polytrifluoroethylene, polytetrafluoroethylene, polyhexafluoroethylene, polyvinyl fluoride, polyvinylidene fluoride and polychlorotrifluoroethylene; polyester; polycarbonate; polyamide, polyimide, and the like. Examples of the thermosetting resins include phenolic resins, epoxy resins, dially phthalate resins, unsaturated polyester resins, melamine resins, urea resins, alkyd resins and benzoguanamine resins. Examples of crosslinked resins include crosslinked methyl methacrylate resins and crosslinked melamine resins. The resin particles may be used alone or in a combination of two or more kinds of them.

Further, in order to impart a negative electrostatic charge to a toner, it is preferred that the resin particles in the fourth invention contain a nitrogen atom to form a structural component having an electron donating characteristic. In this connection, for example, a crosslinked or uncrosslinked melamine resin, polyamide resins and the like are suitable.

The average particle diameter of the resin particles in the fourth invention is preferably 0.1 to 2 μm, more preferably 0.2 to 1 μm. If the average particle diameter is less than 0.1 μm, the level of dispersion in a coating layer becomes extremely poor, whereas, if the average particle diameter is greater than 2 μm, the particles tend to be separated from the coating layer, which makes it impossible to maintain the inherent function of the particles.

In the fourth invention, the incorporated amount of the resin particles is preferably in the range of 5 to 50% by weight, particularly 5 to 30% by weight, based on the weight of the total resins in the resin coating layer. The-resin particles in an amount of less than 5% by weight cannot impart a sufficient amount of electric charge to the toner, whereas if the amount of the resin particles is more than 50% by weight, the resin particles tend to be separated from the carrier surface.

The resin particles described above may be produced by the same manufacturing processes as those described in the first through third inventions.

It is preferred that the resin particles be uniformly dispersed in the matrix resin and the hardness of the resin particles be higher than that of the matrix resin. The resin particles having a higher level of hardness can create minute protrusions and cavities on the surface of the resin coating layer and maintain them so that the surface wear of the resin coating layer is reduced.

The matrix resin for the carrier in the fourth invention may comprise the matrix resins described in the first through third inventions. These resins may be used alone or in a combination of two or more of them. Further, the matrix resin may be the same as the thermosetting resin for resin particles.

In order to prevent the contamination of the carrier surface, the matrix resin has a low surface energy, preferably indicated by 35 dyn/cm or less, more preferably 30 dyn/cm or less.

Examples of the resins, which produces a surface having a low surface energy of a critical surface tension of 35 dyn/cm or less, are the same as those described in the first and second inventions.

It is preferred that the matrix resin comprise a fluorine-containing resin, polymer and/or a silicone resin having a critical surface tension of 30 dyn/cm or less.

Examples of materials for the carrier of the fourth invention include magnetic metals, such as iron, steel, nickel and cobalt, magnetic oxides, such as ferrite and mangetite, and glass beads. Preferably, the material for the carrier is a magnetic material for the utilization of a magnetic brush. The average particle diameter of the carrier core of the fourth invention is generally in the range of 10 to 500 μm, preferably of 30 to 100 μm.

As for the method for forming a coating layer on the surface of a core in the fourth invention, the methods described in the first through third inventions can also be used. The kneader coater method is particularly preferable in the fourth invention, too.

As for the solvent for a solution for forming a coating layer, the same solvents as those described in the first and second inventions can be used.

The coated amount of the resin coating layer in the fourth invention is in the range of 0.05 to 5 parts by weight, preferably 0.1 to 3 parts by weight, based on 100 parts by weight of the core material.

In the fourth invention, both black toner and color toner can be used and the toner comprises a colorant and a binder resin. The colorant may be any of the colorants described in the first through third inventions.

The binder resin may be any of the binder resins described in the first through third invention. Typical examples of the binder resin for the toner in the fourth invention include polystyrenes, styrene/alkyl acrylate copolymers, styrene/alkyl methacrylate copolymers, styrene/acrylonitrile copolymers, styrene/butadiene copolymers, styrene/maleic anhydride copolymers, polyethylene and polypropylene. Other examples include polyesters, polyurethanes, epoxy resins, silicone resins, polyamides, modified rosins, paraffin and wax. Among the foregoing binder resins, polyesters are particularly effective as a binder resin. For example, a linear polyester resin, which is composed of a polycondensation product mainly of bisphenol A and polybasic aromatic carboxylic acid, is suitable.

It is particularly preferred that the binder resin has a softening point in the range of 90° to 150° C., a glass transition point in the range of 50° to 70° C., a number average molecular weight in the range of 2,000 to 6,000, a weight average molecular weight in the range of 8,000 to 15,000, an acid value in the range of 5 to 30 and a hydroxyl value in the range of 5 to 40.

If necessary, the toner particles may contain a known additive such as an electrostatic charge controller and a fixing aid.

EXAMPLES

As described below, the first invention is explained by Examples 1–13; the second invention is explained by Examples 14–19; the third invention is explained by Examples 20–24; and the fourth invention is explained by Examples 25–28.

Example 1

Preparation of carriers
Carrier 1-A

| | Parts by weight |
|---|---|
| Ferrite particles<br>Average particle diameter: 50 μm | 100 |
| Toluene | 14 |
| Styrene/methyl methacrylate copolymer<br>Monomer ratio = 7:3; Mw: 50,000; critical surface tension: 35 dyn/cm | 1.0 |
| Crosslinked benzoguanamine resin particles | 0.2 |

-continued

Preparation of carriers

Carrier 1-A

| | Parts by weight |
|---|---|
| Critical surface tension: 60 dyn/cm; average particle diameter: 0.5 μm; insoluble in toluene | |

All of the above-identified components except for the ferrite particles were dispersed by use of a stirrer for 10 minutes to prepare a solution for forming a coating layer. The solution for forming the coating layer and the ferrite particles were placed in a kneader equipped with a vacuum deaerator. The contents were stirred for 30 minutes at 60° C. to distill off the toluene under reduced pressure to thereby form a carrier having a resin coating layer to obtain Carrier 1-A.

Example 2

Carrier 1-B

| | Parts by weight |
|---|---|
| Ferrite particles<br>Average particle diameter: 45 μm | 100 |
| Toluene | 14 |
| Perfluorooctylethyl acrylate/methyl methacrylate copolymer<br>Monomer ratio = 4:6; Mw: 50,000; critical surface tension: 24 dyn/cm | 0.7 |
| Crosslinked melamine resin particles<br>Critical surface tension: 65 dyn/cm; average particle diameter: 0.3 μm; insoluble in toluene | 0.3 |

All of the above-identified components except for the ferrite particles were dispersed by use of a stirrer for 10 minutes to prepare a solution for forming a coating layer. The solution for forming the coating layer and the ferrite particles were placed in a kneader equipped with a vacuum deaerator. The contents were stirred for 30 minutes at 60° C. to distill off the toluene under reduced pressure to thereby form a carrier having a resin coating layer to obtain Carrier 1-B.

Comparative Example 1

Carrier 1-C

Carrier 1-C was obtained by repeating the procedure of Example 1 except that the benzoguanamine resin particles were not used.

Comparative Example 2

Carrier 1-D

| | Parts by weight |
|---|---|
| Ferrite particles<br>Average particle diameter: 45 μm | 100 |
| Toluene | 14 |
| Perfluorooctylethyl acrylate/methyl methacrylate copolymer<br>Monomer ratio = 3:7; Mw: 60,000; critical surface tension: 24 dyn/cm | 0.5 |
| Methyl methacrylate/dimethylethyl methacrylate copolymer<br>Monomer ratio = 95:5; Mw: 80,000; critical surface tension: 42 dyn/cm | 0.3 |

All of the above-identified components except for the ferrite particles were dispersed by use of a stirrer for 10 minutes to prepare a solution for forming a coating layer. The solution for forming the coating layer and the ferrite particles were placed in a kneader equipped with a vacuum deaerator. The contents were stirred for 30 minutes at 60° C. to distill off the toluene under reduced pressure to thereby form Carrier 1-D with a resin coating layer.

Comparative Example 3

Carrier 1-E

| | Parts by weight |
|---|---|
| Ferrite particles<br>Average particle diameter: 45 μm | 100 |
| Toluene | 14 |
| Perfluorooctylethyl acrylate/methyl methacrylate copolymer<br>Monomer ratio = 4:6; Mw: 60,000; critical surface tension: 24 dyn/cm | 0.5 |
| Uncrosslinked melamine resin<br>Not in a particulate state | 0.3 |

All of the above-identified components except for the ferrite particles were dispersed by use of a stirrer for 10 minutes to prepare a solution for forming a coating layer. The solution for forming the coating layer and the ferrite particles were placed in a kneader equipped with a vacuum deaerator. The contents were stirred for 30 minutes at 60° C. to distill off the toluene under reduced pressure. Then, the temperature was raised to 150° C. and the contents were stirred for 60 minutes to thereby form Carrier 1-E having a resin coating layer including a crossliked melamine resin.

Comparative Example 4

Carrier 1-F

| | Parts by weight |
|---|---|
| Ferrite particles<br>Average particle diameter: 45 μm | 100 |
| Toluene | 14 |
| Perfluorooctylethyl acrylate/methyl methacrylate copolymer<br>Monomer ratio = 4:5; Mw: 50,000; critical surface tension: 24 dyn/cm | 0.6 |
| Crosslinked methyl methacrylate resin particles (thermoplastic)<br>Average particle diameter: 0.3 μm; insoluble but swells in toluene | 0.3 |

All of the above-identified components except for the ferrite particles were dispersed by use of a stirrer for 10 minutes to prepare a solution for forming a coating layer. The solution for forming the coating layer and the ferrite particles were placed in a kneader equipped with a vacuum deaerator. The contents were stirred for 60 minutes at 60° C. to distill off the toluene under reduced pressure to thereby form Carrier 1-F having a resin coating layer.

Preparation of developer 1

Six developers were prepared by blending 100 parts by weight of each of the carriers, which had been prepared in Examples 1–2 and in Comparative Examples 1–4, with 6 parts by weight of Toner 1-A indicated below. These developers were designated as Developers 1–1 and 1–2 (within the first invention, indicated with * in the table and the same is applicable hereinbelow) and 1–3 to 1–6 (out of the first invention), respectively.

Toner 1-A was a magenta toner which had a particle diameter of 8 μm and was prepared in the following way.

| Toner 1-A | % by weight |
|---|---|
| Linear polyester resin<br>A linear polyester obtained from terephthalic acid/bisphenol A ethylene oxide adduct/cyclohexane dimethanol; Tg = 62° C.; Mn = 4,000; Mw = 35,000; Acid Value = 12; Hydroxyl Value = 25 | 100 |
| Magenta pigment<br>(C. I. Pigment Red 57) | 3 |

The above-identified components were blended in an extruder, and thereafter pulverized by means of a jet mill. The resultant powder was treated by a classifier utilizing wind force to obtain particles of magenta toner of $d_{50}$=8 μm. The magenta toner particles were blended with 0.4% by weight of silica ("R972" from Nippon Aerosil Co., Ltd.) by means of a Henschel mixer to obtain magenta toner (Toner 1-A).

Test and evaluation

Utilizing these developers, a copying test was conducted by means of a copying machine of electrostatic photography ("A-Color 630" from Fuji Xerox Co., Ltd.). The results are shown in Table 1.

provided stabilized images which were free of such defects as fluctuation in the image density and background fogging. Measurements of the charge amounts were conducted at the initial stage, at the stage after taking 3,000 copies and at the stage after taking 10,000 copies. On the other hand, Developers 1–3 to 1–6 caused a gradual reduction in the charge amount to an extent that background fogging was observed. Stains due to these toners were observed on the interior of the copying machine.

Preparation of developer 2

Six developers were prepared by blending 100 parts by weight of each of the carriers, which had been prepared in Examples 1–2 and in Comparative Examples 1–4, with 6 parts by weight of Toner 1-B indicated below. These developers were designated as Developers 1–7 and 1–8 (within the first invention) and 1–9 to 1–12 (out of the first invention), respectively.

Toner 1-B was a black toner which had a particle diameter of 9 μm and was prepared in the following way.

| Toner 1-B | % by weight |
|---|---|
| Linear polyester resin<br>A linear polyester obtained from terephthalic acid/bisphenol A ethylene oxide adduct/cyclohexane dimethanol; Tg = 62° C.; Mn = 4,000; Mw = 35,000; Acid Value = 12; Hydroxyl Value = 25 | 100 |
| Carbon black<br>"Morgal L" from Cabot Co. | 6 |

The above-identified components were blended in an extruder, and thereafter pulverized by means of a mill. The resultant powder was treated by a classifier utilizing wind force to obtain particles of black toner of $d_{50}$=9 μm. The particles of the black toner were blended with 0.4% by weight of silica ("R972" from Nippon Aerosil Co., Ltd.) by means of a Henschel mixer to obtain black toner (Toner 1-B).

TABLE 1

| | | | Initial stage | | After 3,000 copies | | After 10,000 copies | |
|---|---|---|---|---|---|---|---|---|
| Resin coated carrier | Toner | Developer No. | Charge amount (μC/g) | Background fogging | Charge amount (μC/g) | Background fogging | Charge amount (μC/g) | Background fogging |
| 1-A | 1-A | 1-1* | −23.1 | ○ | −20.1 | ○ | −18.1 | ○ |
| 1-B | 1-A | 1-2* | −27.5 | ○ | −23.2 | ○ | −23.0 | ○ |
| 1-C | 1-A | 1-3 | −18.2 | ○ | −16.4 | x | −15.6 | x x |
| 1-D | 1-A | 1-4 | −20.0 | ○ | −17.0 | x | −15.0 | x x |
| 1-E | 1-A | 1-5 | −23.9 | ○ | −18.6 | ○ | −14.1 | x x |
| 1-F | 1-A | 1-6 | −23.8 | ○ | −26.8 | ○ | −15.8 | x x |

In Table 1, the amounts of charge indicate values obtained by image analysis according to CSG (Charge Spectrography) . Fog was evaluated by visual inspection of copies. (The same applies to the following Tables 1–5).

○indicates that no fog was observed; X indicates that a slight fog was discernible by comparison of white paper before use and the white part of the paper after copying; and X X indicates that a high fog was observed.

In the copying test, 10,000 copies were made utilizing the above-described toners at moderate temperature and humidity (22° C., 55%RH), Developers 1—1 and 1–2 generally Test and evaluation Utilizing these developers, a copying test was conducted by means of a copying machine of electrostatic photography ("A-Color 630" from Fuji Xerox Co., Ltd.). The results are shown in Table 2.

TABLE 2

| | | | Initial stage | | After 3,000 copies | | After 10,000 copies | |
|---|---|---|---|---|---|---|---|---|
| Resin coated carrier | Toner | Developer No. | Charge amount (μC/g) | Background fogging | Charge amount (μC/g) | Background fogging | Charge amount (μC/g) | Background fogging |
| 1-A | 1-B | 1-7* | −21.5 | ○ | −20.7 | ○ | −17.4 | ○ |
| 1-B | 1-B | 1-8* | −18.2 | ○ | −17.9 | ○ | −18.0 | ○ |
| 1-C | 1-B | 1-9 | −20.8 | ○ | −17.0 | x | −15.2 | x |
| 1-D | 1-B | 1-10 | −20.1 | ○ | −16.0 | x | −13.5 | x x |
| 1-E | 1-B | 1-11 | −22.9 | ○ | −16.0 | x | −13.1 | x x |
| 1-F | 1-B | 1-12 | −20.8 | ○ | −19.8 | ○ | −14.8 | x x |

In the coping test,10,000 copies were made utilizing the above-described toners at moderate temperature and humidity (22° C., 55%RH), Developers 1–7 and 1–8 generally provided stabilized images which were free of such defects as fluctuation in the image density and background fogging. Measurements of the charge amounts were conducted at the initial stage, at the stage after taking 3,000 copies and at the stage after taking 10,000 copies. On the other hand, Developers 1–9 to 1–12 caused gradual reduction in the charge amount to an extent that background fogging was observed. Stains due to these toners were observed on the interior of the copying machine .

Example 3

Preparation of carriers

| Carrier 1-G | Parts by weight |
|---|---|
| Ferrite particles<br>Average particle diameter: 50 μm | 100 |
| Toluene | 14 |
| Styrene/methyl methacrylate copolymer<br>Monomer ratio = 7:3; Mw: 70,000; critical surface tension: 35 dyn/cm | 1.2 |
| Crosslinked benzoguanamine resin particles<br>Critical surface tension: 60 dyn/cm; average particle diameter: 0.4 μm; insoluble in toluene | 0.2 |

All of the above-identified components except for the ferrite particles were dispersed by use of a stirrer for 10 minutes to prepare a solution for forming a coating layer. The solution for forming the coating layer and the ferrite particles were placed in a kneader equipped with a vacuum deaerator. The contents were stirred for 30 minutes at 60° C. to distill off the toluene under reduced pressure to thereby form Carrier 1-G having a resin coating layer.

The resin coating layer had a calculated thickness of 0.48 μm.

Example 4

Carrier 1-H

| | Parts by weight |
|---|---|
| Ferrite particles<br>(average particle diameter: 45 μm) | 100 |
| Toluene | 14 |
| Perfluorooctylethyl acrylate/methyl methacrylate copolymer<br>Monomer ratio = 4:6; Mw: 50,000; critical surface tension: 24 dyn/cm | 1.0 |
| Crosslinked melamine resin particles | 0.3 |

-continued

Carrier 1-H

| | Parts by weight |
|---|---|
| Critical surface tension: 65 dyn/cm; average particle diameter: 0.3 μm; insoluble in toluene | |

All of the above-identified components except for the ferrite particles were dispersed by use of a stirrer for 10 minutes to prepare a solution for forming a coating layer. The solution for forming the coating layer and the ferrite particles were placed in a kneader equipped with a vacuum deaerator. The contents were stirred for 30 minutes at 60° C. to distill off the toluene under reduced pressure to thereby form Carrier 1-H having a resin coating layer.

The resin coating layer had a calculated thickness of 0.36 μm.

Comparative Example 5

Carrier 1-I

Carrier 1-I was obtained by repeating the procedure of Example 3 except that the benzoguanamine resin particles were not used.

Preparation of developer 3

Eight developers were prepared by blending 100 parts by weight of each of the carriers, which had been prepared in Examples 3 and 4, Comparative Example 5, Comparative Examples 2–4, with 6 parts by weight of the aforedescribed Toner 1-A. These developers were designated as Developers 1–21 and 1–22, Developers 1–23 to 1–26 (out of the first invention), respectively.

Test and evaluation

Utilizing these developers, a copying test was conducted by means of a copying machine of electrostatic photography ("A-Color 630" from Fuji Xerox Co., Ltd.). The results are shown in Table 3.

TABLE 3

| Resin coated carrier | Toner | Developer No. | Initial stage Charge amount (μC/g) | Initial stage Background fogging | After 3,000 copies Charge amount (μC/g) | After 3,000 copies Background fogging | After 10,000 copies Charge amount (μC/g) | After 10,000 copies Background fogging |
|---|---|---|---|---|---|---|---|---|
| 1-G | 1-A | 1-21* | −23.1 | ○ | −18.1 | ○ | −20.1 | ○ |
| 1-H | 1-A | 1-22* | −27.5 | ○ | −23.0 | ○ | −23.6 | ○ |
| 1-I | 1-A | 1-23 | −18.2 | ○ | −15.6 | x x | — | — |
| 1-E | 1-A | 1-24 | −20.0 | ○ | −15.0 | x x | — | — |
| 1-F | 1-A | 1-25 | −23.9 | ○ | −14.1 | x x | — | — |
| 1-G | 1-A | 1-26 | −23.8 | ○ | −15.8 | x x | — | |

After the 30,000 copying test at moderate temperature and humidity (22° C., 55%RH), Developers 1–21 and 1–22 generally provided stabilized images which were free of such defects as fluctuation in the image density and background fogging. Measurements of the charge amounts were conducted at the initial stage, at the stage after taking 10,000 copies and at the stage after taking 30,000 copies. On the other hand, Developers 1–23 to 1–26 caused gradual reduction in the charge amount to an extent that, after taking 10,000 copies, background fogging was observed and stains due to these toners were observed on the interior of the copying machine.

Preparation of developer 4

Six developers were prepared by blending 100 parts by weight of each of the carriers, which had been prepared in Examples 3 and 4, Comparative Example 2, with 6 parts by weight of the aforedescribed Toner 1-B. These developers were designated as Developers 1–29 and 1–30, and Developer 1–31 (out of the first invention), respectively.

Test and evaluation

Utilizing these developers, a copying test was conducted by means of a copying machine of electrostatic photography ("A-Color 630" from Fuji Xerox Co., Ltd.). The results are shown in Table 4.

TABLE 4

| Resin coated carrier | Toner | Developer No. | Initial stage Charge amount (μC/g) | Initial stage Background fogging | After 3,000 copies Charge amount (μC/g) | After 3,000 copies Background fogging | After 10,000 copies Charge amount (μC/g) | After 10,000 copies Background fogging |
|---|---|---|---|---|---|---|---|---|
| 1-G | 1-B | 1-29* | −21.5 | ○ | −17.4 | ○ | −18.4 | ○ |
| 1-H | 1-B | 1-30* | −18.2 | ○ | −18.0 | ○ | −18.9 | ○ |
| 1-E | 1-B | 1-31 | −20.8 | ○ | −14.8 | x | — | — |

In the 30,000 copying test at moderate temperature and humidity (22° C., 55%RH), Developers 1–29 and 1–30 generally provided stabilized images which were free of such defects as fluctuation in the image density and background fogging. Measurements of the charge amounts were conducted at the initial stage, at the stage after taking 10,000 copies and at the stage after taking 30,000 copies. On the other hand, Developer 1–31 caused gradual reduction in the charge amount to an extent that, after taking 10,000 copies, background fogging was observed and stains due to these toners were observed on the interior of the copying machine.

Example 7

Preparation of carriers
Carrier 1-L

| | Parts by weight |
|---|---|
| Cu—Mg-based ferrite particles<br>SF1 = 14d, SF2 = 117; average particle diameter: 50 μm | 100 |
| Toluene | 14 |
| Styrene/methyl methacrylate copolymer<br>Monomer ratio = 7:3; Mw: 60,000; critical surface tension: 35 dyn/cm | 1.0 |
| Phenolic resin particles<br>Critical surface tension: 40 dyn/cm; average particle diameter: 0.5 μm: insoluble in toluene | 0.2 |

All of the above-identified components except for the ferrite particles were dispersed by use of a stirrer for 10 minutes to prepare a solution for forming a coating layer. The solution for forming the coating layer and the ferrite particles were placed in a kneader equipped with a vacuum deaerator. The contents were stirred for 30 minutes at 60° C. to distill off the toluene under reduced pressure to thereby form Carrier 1-L having a resin coating layer.

Example 8

Carrier 1-M

| | Parts by weight |
|---|---|
| Cu—Mg-based ferrite particles<br>SF1 = 140, SF2 = 117; average particle diameter: 50 μm | 100 |
| Toluene | 14 |
| Styrene/methyl methacrylate copolymer<br>Monomer ratio = 7:3; Mw: 60,000; critical surface tension: 35 dyn/cm | 0.2 |
| Perfluorooctylethyl acrylate/methyl methacrylate copolymer | 0.4 |

-continued

| Carrier 1-M | Parts by weight |
|---|---|
| Monomer ratio = 4:6; Mw: 60,000; critical surface tension: 24 dyn/cm | |
| Crosslinked melamine resin particles Critical surface tension: 24 dyn/cm; average particle diameter: 0.3 μm; insoluble in toluene | 0.2 |

All of the above-identified components except for the ferrite particles were dispersed by use of a stirrer for 10 minutes to prepare a solution for forming a coating layer. The solution for forming the coating layer and the ferrite particles were placed in a kneader equipped with a vacuum deaerator. The contents were stirred for 30 minutes at 60° C. to distill off the toluene under reduced pressure to thereby form Carrier 1-M having a resin coating layer.

Example 9

| Carrier 1-N | Parts by weight |
|---|---|
| Cu—Zn-based ferrite particles SF1 = 133, SF2 = 110; average particle diameter: 45 μm | 100 |
| Toluene | 14 |
| Perfluorooctylethyl acrylate/methyl methacrylate copolymer Monomer ratio = 4:6; Mw: 60,000; critical surface tension: 24 dyn/cm | 0.7 |
| Crosslinked melamine resin particles Critical surface tension: 65 dyn/cm; average particle diameter: 0.3 μm; insoluble in toluene | 0.3 |

All of the above-identified components except for the ferrite particles were dispersed by use of a stirrer for 10 minutes to prepare a solution for forming a coating layer. The solution for forming the coating layer and the ferrite particles were placed in a kneader equipped with a vacuum deaerator. The contents were stirred for 30 minutes at 60° C. to distill off the toluene under reduced pressure to thereby form Carrier 1-N having a resin coating layer.

Example 10

Carrier 1-O

Carrier 1-O was obtained by repeating the procedure for the preparation of Carrier 1-M, except that the core particles were changed to Cu-Mg-based ferrite particles with an average particle diameters of 60 μm and shape factor SF1 of 125 and SF2 of 107.

Example 11

Carrier 1-P

Carrier 1-P was obtained by repeating the procedure for the preparation of Carrier 1-M, except that the core particles were change to Cu-Mg-based ferrite particles with an average particle diameters of 40 μm and SF1 of 140 and SF2 of 115.

Example 12

Carrier 1-Q

Carrier 1-Q was obtained by repeating the procedure for the preparation of Carrier 1-N, except that the core particles were change to Cu-Zn-based ferrite particles with an average particle diameters of 48 μm and SF1 of 140 and SF2 of 115.

Example 13

Carrier 1-R

Carrier 1-R was obtained by repeating the procedure for the preparation of Carrier 1-N, except that the core particles were change to Cu-Zn-based ferrite particles with an average particle diameters of 35 μm and SF1 of 147 and SF2 of 118.

Preparation of developer 5

Developers were prepared by blending 100 parts by weight of each of the aforedescribed Carriers 1-L to 1-R with 7 parts by weight of the aforedescribed Toner 1-A by means of a tumbler shaker mixer. These developers were designated as Developers 1–41 to 1–47, respectively.

Developers were prepared by blending 100 parts by weight of each of the aforedescribed Carriers 1-P to 1-R with 7 parts by weight of the aforedescribed Toner 1-B by means of a tumbler shaker mixer. These developers were designated as Developers 1–48 to 1–50, respectively.

Test and evaluation

Utilizing these developers, a copying test was conducted by means of a copying machine of electrostatic photography ("A-Color 630" from Fuji Xerox Co., Ltd.). The results are shown in Table 5.

TABLE 5

| | | | | Initial Stage | | | After 5,000 copies | | | After 20,000 copies | | |
|---|---|---|---|---|---|---|---|---|---|---|---|---|
| Resin coated carrier | Core SF1 | Core SF2 | Developer No. | Charge amount (μC/g) | Distribution of electrostatic charge | Background fogging | Charge amount (μC/g) | Distribution of electrostatic charge | Background fogging | Charge amount (μC/g) | Distribution of electrostatic charge | Background fogging |
| 1-L | 140 | 117 | 1-41* | −26.5 | 0.6 | ○ | −22.5 | 0.6 | ○ | −20.5 | 0.6 | ○ |
| 1-M | 140 | 117 | 1-42* | −18.2 | 0.5 | ○ | −23.4 | 0.7 | ○ | −20.6 | 0.7 | ○ |
| 1-N | 133 | 110 | 1-43* | −22.0 | 0.5 | ○ | −23.4 | 0.7 | ○ | −19.6 | 0.6 | ○ |
| 1-O | 125 | 107 | 1-44* | −23.9 | 0.6 | ○ | −21.6 | 0.6 | ○ | −22.6 | 0.7 | ○ |
| 1-P | 140 | 115 | 1-45* | −23.8 | 0.6 | ○ | −25.8 | 0.7 | ○ | −20.3 | 0.6 | ○ |
| 1-Q | 140 | 115 | 1-46* | −23.6 | 0.6 | ○ | −18.2 | 0.6 | ○ | 18.2 | 0.8 | ○ |
| 1-R | 147 | 118 | 1-47* | −26.1 | 0.8 | ○ | −22.9 | 0.7 | ○ | −20.5 | 1.1 | x |
| 1-P | 140 | 115 | 1-48* | −21.5 | 0.6 | ○ | −22.8 | 0.7 | ○ | −20.3 | 0.6 | ○ |

TABLE 5-continued

| Resin coated carrier | Core SF1 | Core SF2 | Developer No. | Initial Stage: Charge amount (μC/g) | Initial Stage: Distribution of electrostatic charge | Initial Stage: Background fogging | After 5,000 copies: Charge amount (μC/g) | After 5,000 copies: Distribution of electrostatic charge | After 5,000 copies: Background fogging | After 20,000 copies: Charge amount (μC/g) | After 20,000 copies: Distribution of electrostatic charge | After 20,000 copies: Background fogging |
|---|---|---|---|---|---|---|---|---|---|---|---|---|
| 1-Q | 140 | 115 | 1-49* | −21.0 | 0.6 | ○ | −18.3 | 0.6 | ○ | −18.2 | 0.8 | ○ |
| 1-R | 147 | 118 | 1-50* | −23.5 | 0.8 | ○ | −17.6 | 0.7 | ○ | −18.5 | 1.0 | x |

In the table, the distribution of electrostatic charge is defined by {Q(80)–Q(20)}/Q(50), where Q(80) is the charge amount at 80 percent cumulative charge amount, Q(50) is the charge amount at 50 percent cumulative charge amount and Q(20) is the charge amount at 20 percent cumulative charge amount.

In the copying test, 20,000 copies were made utilizing the above-described developers at moderate temperature and humidity (22° C., 55%RH). Measurements of the amounts and distributions of electrostatic charge were conducted at the initial stage, at the 5,000 copy stage, and at the 20,000 copy stage. Developers 1–31 to 1–36 and Developers 1–38 and 1–39, which were each a preferred embodiment of the first invention, were particularly superior in providing stabilized images free of such defects as fluctuation in the image density and background fogging.

In order to give more concrete details of the second invention, the following Examples 14 through 19 are given by way of illustration and not by way limitation. All parts are by weight and % means weight percentage, unless otherwise specified.

Example 14

Resin Preparation 1 (Polyester Resin 2-A)

| | Moles |
|---|---|
| Bisphenol A/ethylene oxide diadduct | 35 |
| Bisphenol A/propylene oxide diadduct | 15 |
| Dodecenylsuccinic acid | 32 |
| Terephthalic acid | 40 |
| Trimellitic acid | 6 |

The above-described composition was placed in a 4-necked round-bottom flask equipped with a stainless steel stirrer, a glass inlet tube for nitrogen gas and a reflux condenser. While blowing in nitrogen gas, the reaction mixture was heated by means of a mantle heater. The reaction mixture was added with 0.5g of dibutyltin oxide and thereafter was left to react at 200° C. for 8 hours while distilling off the generated water. The obtained Polyester Resin 2-A had Tg=66° C. and a content of THF-insoluble matters of 20%.

Resin Preparation 2 (Polyester Resin 2-B)

| | Moles |
|---|---|
| Bisphenol A/ethylene oxide diadduct | 25 |
| Bisphenol A/propylene oxide diadduct | 25 |
| Dodecenylsuccinic acid | 10 |

-continued

Resin Preparation 2 (Polyester Resin 2-B)

| | Moles |
|---|---|
| Terephthalic acid | 30 |
| Trimellitic acid | 10 |

The preparation procedure of Resin Preparation 1 was repeated in the same way except that the above-described composition was employed. The obtained Polyester Resin 2-B had Tg=about 67° C. and a content of THF-insoluble matters of 16%.

Resin Preparation 3 (Polyester Resin 2-C)

| | Moles |
|---|---|
| Bisphenol A/ethylene oxide diadduct | 30 |
| Bisphenol A/propylene oxide diadduct | 20 |
| Dodecenylsuccinic acid | 15 |
| Terephthalic acid | 30 |
| Trimellitic acid | 5 |

The preparation procedure of Resin Preparation 1 was repeated in the same way except that the above-described composition was employed. The obtained Polyester Resin 2-C had Tg=about 64° C. and a content of THF-insoluble matters of 8%.

Resin Preparation 4 (Polyester Resin 2-D)

| | Moles |
|---|---|
| Bisphenol A/ethylene oxide diadduct | 10 |
| Bisphenol A/propylene oxide diadduct | 15 |
| Neopentyl glycol | 24 |
| Terephthalic acid | 22 |
| Isophthalic acid | 20 |

The preparation procedure of Resin Preparation 1 was repeated in the same way except that the above-described composition was employed. The obtained Polyester Resin 2-D had Tg=about 65° C. and a content of THF-insoluble matters of 0%.

Resin Preparation 5 (Polyester Resin 2-E)

| | Moles |
|---|---|
| Bisphenol A/ethylene oxide diadduct | 30 |
| Bisphenol A/propylene oxide diadduct | 15 |
| Dodecenylsuccinic acid | 30 |

-continued

Resin Preparation 5 (Polyester Resin 2-E)

| | Moles |
|---|---|
| Terephthalic acid | 30 |
| Trimellitic acid | 15 |

The preparation procedure of Resin Preparation 1 was repeated in the same way except that the above-described composition was employed. The obtained Polyester Resin 2-E had Tg=about 69° C. and a content of THF-insoluble matters of 37%.

In the second invention, the glass transition point Tg was measured by means of a differential calorimeter manufactured by Nippon Electronics Co., Ltd., according to the following procedure: a sample was pre-heated for 17 hours in a thermostatted chamber of 40° C. in advance and thereafter was heated up at a rate of 10° C./minute, wherein the intersecting point, which was defined by the extended baseline at temperatures below the glass transition point and a tangential line having maximum slope before reaching the top of the peak, was defined as the glass transition point Tg.

Example 15

Carrier 2-A

| | Parts by weight |
|---|---|
| Ferrite particles<br>Average particle diameter: 45 μm | 100 |
| Toluene | 14 |
| Perfluorooctylethyl acrylate/methyl methacrylate copolymer<br>Monomer ratio = 40:60; Mw: 63,000 | 1.6 |
| Carbon black<br>"VXC-72" from Cabot Co.; DBP absorption: 174 ml/100 g; average particle diameter: 30 nm | 0.12 |
| Crosslinked melamine resin particles<br>Average particle diameter: 0.3 μm; insoluble in toluene | 0.3 |

All of the above-identified components except for the ferrite particles were dispersed by use of a stirrer for 10 minutes to prepare a solution for forming a coating layer. The solution for forming the coating layer and the ferrite particles were placed in a kneader equipped with a vacuum deaerator. The contents were stirred for 30 minutes at 60° C. to distill off the toluene under reduced pressure to thereby form Carrier 2-A having a resin coating layer. (It should be noted that the carbon black had been dispersed in the perfluorooctylethyl acrylate/methyl methacrylate copolymer as a coating resin with toluene by use of a sand mill).

Carrier 2-B

| | Parts by weight |
|---|---|
| Ferrite particles<br>Average particle diameter: 45 μm | 100 |
| Toluene | 14 |
| Perfluorooctylethyl acrylate/methyl methacrylate copolymer<br>Monomer ratio = 40:60; Mw: 65,000 | 1.7 |
| Electroconductive powder<br>Tin oxide "S-1" from Mitsubishi Material Corp.; average particle diameter: 20 nm | 0.6 |

-continued

Carrier 2-B

| | Parts by weight |
|---|---|
| Crosslinked melamine resin particles<br>Average particle diameter: 0.3 μm; insoluble in toluene | 0.3 |

All of the above-identified components except for the ferrite particles were dispersed by use of a stirrer for 10 minutes to prepare a solution for forming a coating layer. The solution for forming the coating layer and the ferrite particles were placed in a kneader equipped with a vacuum deaerator. The contents were stirred for 30 minutes at 60° C. to distill off the toluene under reduced pressure to thereby form Carrier 2-B having a resin coating layer. (It should be noted that the electroconductive powder had been dispersed in the perfluorooctylethyl acrylate/methyl methacrylate copolymer as a coating resin with toluene by use of a sand mill).

Carrier 2-C

Carrier 2-C was obtained by repeating the manufacturing procedure for Carrier 2-A. However, the melamine resin particles were not used.

Carrier 2-D

Carrier 2-D was obtained by repeating the manufacturing procedure for Carrier 2-A. However, the carbon black was not used.

Example 16

| | Parts by weight |
|---|---|
| Polyester Resin 2-A | 88 |
| Carbon black<br>"BPL" from Cabot Co. | 6 |
| Polypropylene wax having a low molecular weight "VISCOL 600P" from Sanyo Chemical Industries, Ltd. | 6 |

The above-identified components were pre-mixed, then melt-blended by means of a Banbury mixer, and were spread in the form of a layer, which was subjected to pre-pulverization by means of a hammer mill after being cooled down. The resultant granules were finely divided by means of a jet mill and thereafter treated by a classifier utilizing wind force to obtain toner particles having a volume average particle diameter of 9.3 μm by eliminating undesirably fine particles and coarse particles. The particle size measurement was conducted by means of Coulter Counter Model TA-II (having an aperture diameter of 100 μm) . The binder resin in the toner had a content of THF-insoluble matters of 10 parts by weight. The toner was mixed, calculated with respect to 100 parts by weight thereof, with 0.7 parts by weight of silica treated with a silicone oil (silica available as "TS 720" from Cabot Co.), by means of a Henschel mixer. In this way, Toner 2-A, which had silica particles adhered to the surface thereof, was obtained.

The aforedescribed Carrier 2-A was mixed, calculated with respect to 100 parts by weight thereof, with 6 parts by weight of the above-mentioned Toner 2-A by means of a V-shaped blender to obtain a developer.

Example 17

A developer was obtained by repeating the same procedure as Example 16 except that the aforedescribed Polyester Resin 2-B was used in place of Polyester Resin 2-A to prepare Toner 2-B comprising a binder resin having a content of THF-insoluble matters of 8 parts by weight.

Example 18

A developer was obtained by repeating the same procedure as Example 16 except that the aforedescribed Polyester Resin 2-C was used in place of Polyester Resin 2-A to prepare Toner 2-C comprising a binder resin having a content of THF-insoluble matters of 5 parts by weight.

Example 19

A developer was obtained by repeating the same procedure as Example 16 except that the aforedescribed Carrier 2-B was used in place of Carrier 2-A.

Example 101

A developer was obtained by repeating the same procedure as Example 16 except that the aforedescribed Polyester Resin 2-D was used in place of Polyester Resin 2-A to prepare Toner 2-D comprising a binder resin having a content of THF-insoluble matters of 0 parts by weight.

Example 102

A developer was obtained by repeating the same procedure as Example 16 except that the aforedescribed Polyester Resin 2-E was used in place of Polyester Resin 2-A to prepare Toner 2-E comprising a binder resin having a content of THF-insoluble matters of 28 parts by weight.

Comparative Example 8

A developer was obtained by repeating the same procedure as Example 16 except that the aforedescribed Carrier 2-C was used in place of Carrier 2-A.

Comparative Example 9

A developer was obtained by repeating the same procedure as Example 16 except that the aforedescribed Carrier 2-D was used in place of Carrier 2-A.

Test and evaluation

Utilizing these developers, evaluation was conducted regarding the fixation level by use of a heating roll of 150° C. and regarding offset level by use of a heating roll of 240° C. In addition, utilizing these developers, a copying test was conducted by means of a copying machine of electrostatic photography (a modified version of "ABLE1301 α" from Fuji Xerox Co., Ltd.) test, and 100,000 copies were made at high temperature and humidity (30° C., 90%RH) to evaluate the quality of image at the initial stage as well as charge amounts and fog on the image at the initial stage and at the final stage after taking 100,000 copies.

For the evaluation of fixation level, the samples were bent and the state of bend was visually evaluated in comparison with a standard criterion to be recorded in 5 ratings, namely, ranging from good (G1) to poor (G5).

In the evaluation of offset level, the samples were visually evaluated in comparison with a standard criterion to be recorded in 5 ratings, namely, ranging from good (G1) to poor (G5).

The quality of initial images was visually examined.

The amounts of the electrostatic charge were measured by means of a blow off electrostatic charge meter manufactured by Toshiba Corporation.

Fog on image was visually evaluated in comparison with a standard criterion to be recorded in 5 ratings, namely, ranging from good (G1) to poor (G5).

The results are shown in Table 6.

TABLE 6

| | | | Test of fixation quality | | | Initial stage | | After 100,000 copies | |
|---|---|---|---|---|---|---|---|---|---|
| | Toner | Carrier | Fixation level | Offset level | Initial image | Charge amount (μC/g) | Fog on ground | Charge amount (μC/g) | Fog on ground |
| Ex. 16 | 2-A | 2-A | G1 | G1 | Excellent without edge effect | −23.6 | G1 | −21.4 | G1 |
| Ex. 17 | 2-B | 2-A | G1 | G1 | Excellent without edge effect | −22.1 | G1 | −20.5 | G1 |
| Ex. 18 | 2-C | 2-A | G1 | G1.5 | Excellent without edge effect | −21.9 | G1 | −20.6 | G1 |
| Ex. 19 | 2-A | 2-B | G1 | G1 | Excellent without edge effect | −21.1 | G1 | −18.5 | G1 |
| Ex. 101 | 2-D | 2-A | G1 | G4 | Excellent without edge effect | −21.2 | G1 | −19.9 | G2 |
| Ex. 102 | 2-E | 2-A | G4 | G1 | Excellent without edge effect | −21.2 | G1 | −19.9 | G2 |
| Comp. Ex. 8 | 2-A | 2-C | G1 | G1 | Excellent without edge effect | −16.1 | G1 | −9.4 | G5 |
| Comp. Ex. 9 | 2-A | 2-C | G1 | G1 | Slight edge effect | −26.3 | G1 | −17.2 | G2 |

Ex.: Example
Comp. Ex.: Comparative Example
Under an environment of high temperature and humidity As is apparent from Table 6, all of the developers of Examples 16 through 19, which are in accordance with the second invention, are excellent both in the fixation level and offset level, and these developers generally provide stabilized images which are free of such defects as fluctuation in the image density and background fogging. On the other hand, the developer of Example 101, which uses the resin having a content of THF-insoluble matters of 0 part by weight, provides a poor offset level although the image is stable. The developer of Example 102, which uses the resin having a content of THF-insoluble matters of 28 parts by weight, provides a poor fixation level although the offset level is good. The developer of Comparative Example 8, which uses the carrier containing no resin particles, provides a good fixation level and a good initial image, but has a lower charge amount from the initial stage and exhibits gradual reduction in the charge amount to an extent that background fogging is observed and stains due to these toners are observed on the interior of the copying machine. The developer of Comparative Example 9, which uses the carrier containing no electroconductive particles, provides a good fixation level, but exhibits a slight edge effect on the image and exhibits gradual reduction in the charge amount to an extent that some stains due to these toners are observed on the interior of the copying machine.

In order that more concrete details of the third invention will be clarified, the following Examples 20 through 24 are given by way of illustration and not by way limitation. All parts are by weight, unless otherwise specified.

Example 20

| Toner 3-A | Parts by weight |
|---|---|
| Polyester Resin<br>Synthesized from bisphenol A/ethylene oxide diadduct, bisphenol A/propylene oxide diadduct, terephthalic acid and trimellitic acid; Mw = 14,000; Tg = 62° C. | 87 |
| Carbon black<br>"BPL" from Cabot Co. | 7 |
| Polypropylene wax having a low molecular weight "VISCOL 660P" from Sanyo Chemical Industries, Ltd. | 6 |

The above-identified components were pre-mixed, and melt-blended after the addition of 3 parts by weight of water by means of a twin-screw extruder, while maintaining a temperature of 110° C., and were spread in the form of a layer, which, after being cooled down, was subjected to pre-pulverization by means of a hammer mill. The resultant granules were finely divided by means of a jet mill and thereafter treated by a classifier utilizing wind force to obtain toner particles having a volume average particle diameter of 9.3 μm by eliminating undesirably fine particles and coarse particles. The particle size measurement was conducted by means of Coulter Counter Model TA-II (having an aperture diameter of 100 μm).

Example 21

Preparation of titanium dioxide additives

In the preparation of additives 3-a and 3-b, a rutile titanium dioxide ("MT-150A" from Teika Co., Ltd.) having an average particle diameter of 15 nm was used as a wet process titanium dioxide. The titanium dioxide had a content of water-soluble matters of 0.30% by weight.

Titanium dioxide additive 3-a

The surface of titanium dioxide was treated with decyltrimethoxysilane in the following procedure: One gram of decyltrimethoxysilane was dissolved in a methanol/water (95:5) mixed solvent and thereafter 10 g of titanium dioxide powder, which had a content of water-soluble matters reduced to 0.11% by weight by washing with water, were added to the mixed solvent and the titanium dioxide was dispersed by means of ultrasonic waves. Then, the dispersion was treated and dried in an evaporator to evaporate the volatile matters including methanol and thereafter was thermally treated by means of a drying oven set to a temperature of 120° C. The resulting dry product was pulverized by means of a mortar to obtain the titanium dioxide 3-a as a titanium dioxide surface-treated with decyltrimethoxysilane.

Titanium dioxide additive 3-b

The surface of titanium dioxide was treated with decyltrimethoxysilane in the following procedure: Two grams of decyltrimethoxysilane were dissolved in a methanol/water (95:5) mixed solvent and thereafter 10 g of titanium dioxide powder, which had a content of water-soluble matters reduced to 0.11% by weight by washing with water, were added to the mixed solvent and the titanium dioxide was dispersed by means of ultrasonic waves. Then, the same procedure as in the preparation of the titanium dioxide additive 3-a was repeated to obtain the titanium dioxide 3-b as a titanium dioxide surface-treated with decyltrimethoxysilane Example 22

Preparation of Carriers
Carrier 3-A

| | Parts by weight |
|---|---|
| Ferrite particles<br>Average particle diameter: 45 μm | 100 |
| Toluene | 14 |
| Perfluorooctylethyl acrylate/methyl methacrylate copolymer<br>Monomer ratio = 8:2; Mw: 40,000; critical surface tension: 24 dyn/cm | 1.6 |
| Carbon black<br>"Vulcan XC-72" from Cabot Co.;<br>DBP absorption: 174 ml/100 g | 0.16 |
| Melamine resin particles<br>Critical surface tension: 60 dyn/cm; average particle diameter: 0.3 μm | 0.3 |

All of the above-identified components except for the ferrite particles were dispersed by use of a stirrer for 10 minutes to prepare a solution for forming a coating layer. The solution for forming the coating layer and the ferrite particles were placed in a kneader equipped with a vacuum deaerator. The contents were stirred for 30 minutes at 60° C. to distill off the toluene under reduced pressure to thereby form Carrier 3-A having a resin coating layer.

| Carrier 3-B | Parts by weight |
|---|---|
| Ferrite particles<br>Average particle diameter: 45 μm | 100 |
| Toluene | 14 |
| Styrene/methyl methacrylate copolymer<br>Monomer ratio = 7:3; Mw: 30,000; critical surface tension: 30 dyn/cm | 1.5 |

All of the above-identified components except for the ferrite particles were dispersed by use of a stirrer for 10 minutes to prepare a solution for forming a coating layer. The solution for forming the coating layer and the ferrite particles were placed in a kneader equipped with a vacuum deaerator. The contents were stirred for 30 minutes at 60° C. to distill off the toluene under reduced pressure to thereby form Carrier 3-B having a resin coating layer.

Example 23

The aforedescribed toner particles were mixed, calculated with respect to 100 parts by weight thereof, with 0.2 parts by weight of silica treated with a silicone oil (silica available as "TS 720" from Cabot Co.), and with 1.2 parts of the titanium dioxide additive 3-a prepared in Example 21 by means of a Henschel mixer. In this way, toner, which had silica particles and titanium dioxide adhered to the surface thereof, was obtained.

Six parts of this toner was mixed with 94 parts of Carrier 3-A prepared in Example 22 to obtain Developer 3-1.

Example 24

The aforedescribed toner particles were mixed, calculated with respect to 100 parts by weight thereof, with 0.3 parts by weight of silica treated with a silicone oil (silica available as "TS 720" from Cabot Co.), and with 2 parts of the titanium dioxide additive 3-b prepared in Example 21 by means of a Henschel mixer. Thereafter, in the same way as in Example 23, Developer 3-2 was obtained.

Comparative Example 10

The aforedescribed toner particles were mixed, calculated with respect to 100 parts by weight thereof, with 0.2 parts by weight of silica treated with a silicone oil (silica available as "TS 720" from Cabot Co.), by means of a Henschel mixer. In this way, toner, which had silica particles adhered to the surface thereof, was obtained.

Six parts of this toner were mixed with 94 parts of Carrier 3-A prepared in Example 22 to obtain Developer 3-3.

Comparative Example 11

The aforedescribed toner particles were mixed, calculated with respect to 100 parts by weight thereof, with 5 parts of the titanium dioxide additive 3-a prepared in Example 21 by means of a Henschel mixer. In this way, toner, which had titanium dioxide particles adhered to the surface thereof, was obtained.

Six parts of this toner were mixed with 94 parts of Carrier 3-A prepared in Example 22 to obtain Developer 3-4.

Comparative Example 12

The aforedescribed toner particles were mixed, calculated with respect to 100 parts by weight thereof, with 0.2 parts by weight of silica, which had not been treated with a silicone oil (silica available as "R972" from Nippon Aerosil Co., Ltd.), and with 1.2 parts of the titanium dioxide additive 3-a prepared in Example 21by means of a Henschel mixer. In this way, toner, which had silica particles and titanium dioxide adhered to the surface thereof, was obtained.

Six parts of this toner were mixed with 94parts of Carrier 3-A prepared in Example 22to obtain Developer 3-5.

Comparative Example 13

The aforedescribed toner particles were mixed, calculated with respect to 100 parts by weight thereof, with 0.4 parts by weight of silica treated with a silicone oil (silica available as "TS 720" from Cabot Co.), and with 1.2 parts of rutile titanium dioxide, which had not been treated with decyltrimethoxysilane and had an average particle diameter of 15 nm ("MT-150A" from Teika Co., Ltd.), by means of a Henschel mixer. In this way, toner, which had silica particles and titanium dioxide adhered to the surface thereof, was obtained.

Six parts of this toner were mixed with 94 parts of Carrier 3-A prepared in Example 22 to obtain Developer 3-6.

Comparative Example 14

The aforedescribed toner particles were mixed, calculated with respect to 100 parts by weight thereof, with 0.2 parts by weight of silica treated with a silicone oil (silica available as "TS 720" from Cabot Co.), and with 1.2 parts of the titanium dioxide additive 3-a prepared in Example 21 by means of a Henschel mixer. In this way, toner, which had silica particles and titanium dioxide adhered to the surface thereof, was obtained.

Six parts of this toner were mixed with 94 parts of Carrier 3-B prepared in Example 22 to obtain Developer 3-7.

Comparative Example 15

The aforedescribed toner particles were mixed, calculated with respect to 100 parts by weight thereof, with 0.04 parts by weight of silica treated with a silicone oil (silica available as "TS 720" from Cabot Co.), and with 1.2 parts of the titanium dioxide additive 3-a prepared in Example 21 by means of a Henschel mixer. In this way, toner, which had silica particles and titanium dioxide adhered to the surface thereof, was obtained.

Six parts of this toner were mixed with 94 parts of Carrier 3-A prepared in Example 22 to obtain Developer 3-8.

Comparative Example 16

The aforedescribed toner particles were mixed, calculated with respect to 100 parts by weight thereof, with 2.2 parts by weight of silica treated with a silicone oil (silica available as "TS 720" from Cabot Co.), and with 2.0 parts of the titanium dioxide additive 3-a prepared in Example 21 by means of a Henschel mixer. In this way, toner, which had silica particles and titanium dioxide adhered to the surface thereof, was obtained.

Six parts of this toner were mixed with 94 parts of Carrier 3-A prepared in Example 22 to obtain Developer 3-9.

Comparative Example 17

The aforedescribed toner particles were mixed, calculated with respect to 100 parts by weight thereof, with 1.0 part by weight of silica treated with a silicone oil (silica available as "TS 720" from Cabot Co.), and with 0.02 parts of the titanium dioxide additive 3-a prepared in Example 21 by means of a Henschel mixer. In this way, toner, which had silica particles and titanium dioxide adhered to the surface thereof, was obtained.

Six parts of this toner were mixed with 94 parts of Carrier 3-A prepared in Example 22 to obtain Developer 3-10.

Comparative Example 9

The aforedescribed toner particles were mixed, calculated with respect to 100 parts by weight thereof, with 0.1 parts by weight of silica treated with a silicone oil (silica available as "TS 720" from Cabot Co.), and with 2.2 parts of the titanium dioxide additive 3-a prepared in Example 21 by means of a Henschel mixer. In this way, toner, which had silica particles and titanium dioxide adhered to the surface thereof, was obtained.

Six parts of this toner were mixed with 94 parts of Carrier 3-A prepared in Example 22 to obtain Developer 3-11.

Test and evaluation

Utilizing these developers, image evaluation was conducted regarding the image density (ID measurement by means of X-Rite) and fog level (in comparison with a standard criterion) at the initial stage, after taking 30,000 copies and after taking 100,000 copies by means of a copying machine of electrostatic photography (a modified version of "Vivace 550" from Fuji Xerox Co., Ltd.) at high temperature and humidity (30° C., 90% RH) and also at low temperature and humidity (10 ° C., 20% RH). The results are shown in Tables 7 and 8.

TABLE 7

| Image density (X-Rite) | 30° C., 90% RH | | | | 10° C., 20% RH | | | |
|---|---|---|---|---|---|---|---|---|
| | Initial stage | 30,000 copies | 100,000 copies | Rating | Initial stage | 30,000 copies | 100,000 copies | Rating |
| Developer 3-1 (Ex. 23) | 1.455 | 1.423 | 1.433 | ○ | 1.446 | 1.474 | 1.429 | ○ |
| Developer 3-2 (Ex. 24) | 1.399 | 1.413 | 1.405 | ○ | 1.420 | 1.443 | 1.415 | ○ |
| Developer 3-3 (Comp. Ex. 10) | 1.417 | 1.280 | 1.105 | x | 1.432 | 1.203 | 1.097 | x |
| Developer 3-4 (Comp. Ex. 11) | 1.436 | 1.422 | 1.214 | x | 1.411 | 1.440 | 1.103 | x |
| Developer 3-5 (Comp. Ex. 12) | 1.427 | 1.407 | 1.219 | Δ | 1.325 | 1.087 | 1.106 | x |
| Developer 3-6 (Comp. Ex. 13) | 1.398 | 1.207 | 1.215 | Δ | 1.422 | 1.091 | 1.120 | x |
| Developer 3-7 (Comp. Ex. 14) | 1.422 | 1.107 | 1.091 | x | 1.406 | 1.103 | 1.085 | x |
| Developer 3-8 (Comp. Ex. 15) | 1.415 | 1.430 | 1.223 | x | 1.427 | 1.432 | 1.158 | x |
| Developer 3-9 (Comp. Ex. 16) | 1.420 | 1.308 | 1.122 | Δ | 1.389 | 1.254 | 1.089 | x |
| Developer 3-10 (Comp. Ex. 17) | 1.394 | 1.285 | 1.116 | x | 1.375 | 1.262 | 1.093 | x |
| Developer 3-11 (Comp. Ex. 18) | 1.407 | 1.421 | 1.119 | x | 1.434 | 1.387 | 1.136 | x |

Ex.: Example
Comp. Ex.: Comparative Example
Good ← < 1.400 < → Poor
○: Superior
Δ: Somewhat inferior but practically acceptable
x: Inferior

TABLE 8

| Fog (standard deviation) | 30° C., 90% RH | | | | 10° C., 20% RH | | | |
|---|---|---|---|---|---|---|---|---|
| | Initial stage | 30,000 copies | 100,000 copies | Rating | Initial stage | 30,000 copies | 100,000 copies | Rating |
| Developer 3-1 (Ex. 23) | G0 | G0 | G1 | ○ | G0 | G0 | G1 | ○ |
| Developer 3-2 (Ex. 24) | G0 | G0 | G1 | ○ | G0 | G0 | G1 | ○ |
| Developer 3-3 (Comp. Ex. 10) | G0 | G5 | G6 | x | G1 | G5 | G6 | x |
| Developer 3-4 (Comp. Ex. 11) | G1 | G3 | G7 | x | G1 | G3 | G7 | x |
| Developer 3-5 (Comp. Ex. 12) | G1 | G4 | G5 | Δ | G0 | G3 | G6 | x |
| Developer 3-6 (Comp. Ex. 13) | G0 | G5 | G7 | x | G0 | G2 | G7 | x |
| Developer 3-7 (Comp. Ex. 14) | G1 | G4 | G6 | x | G1 | G5 | G6 | x |
| Developer 3-8 (Comp. Ex. 15) | G2 | G4 | G6 | x | G2 | G3 | G6 | x |
| Developer 3-9 (Comp. Ex. 16) | G0 | G3 | G5 | Δ | G2 | G4 | G6 | x |
| Developer 3-10 (Comp. Ex. 17) | G1 | G3 | G5 | Δ | G1 | G3 | G6 | x |
| Developer 3-11 (Comp. Ex. 18) | G1 | G3 | G6 | x | G2 | G4 | G7 | x |

Ex.: Example
Comp. Ex.: Comparative Example
Good ← G0 < G1 < G2 < G3 < G4 < G5 < G6 < G7 → Poor
○: Superior
Δ: Somewhat inferior but practically acceptable
x: Inferior It can be seen from Tables 7 and 8 that Developers 3-1 and 3-2 are superior to Developers 3-3 through 3-11 in image density and fog level at the stage after taking 30,000 copies and also at the stage after taking 100,000 copies both at high temperature and humidity and at low temperature and humidity. The comparison between Developers 3-1, 3-2 and Developers 3-8, 3-9, each different in the amount added of the silica treated with silicone oil, makes it clear that Developers 3-1 and 3-2, which contain the silica in an amount in the range of 0.05 to 2.0 parts by weight based on 100 parts by weight of toner, exhibit better results.

The comparison between Developers 3-1, 3-2 and Developers 3-10, 3-11, each different in the amount added of the surface-treated titanium dioxide, makes it clear that Developers 3-1 and 3-2, which contain the titanium dioxide in an amount in the range of 0.05 to 2.0 parts by weight based on 100 parts by weight of toner, exhibit better results.

Further, it can be seen from the comparison of Developers 3-1 and 3-2 with Developer 3-5 in which the silica is not treated with a silicone oil although surface-treated titanium dioxide and silica are present, that Developers 3-1 and 3-2 , each comprising the silica treated with a silicone oil, are superior in image density at the stage after taking 100,000 copies both at high temperature and humidity and at low temperature and humidity and at the stage after taking 30,000 copies at low temperature and humidity as well as in fog level at the stages after taking 30,000 copies and after taking 100,000 copies both at high temperature and humidity and at low temperature and humidity.

Further, it can be seen from the comparison between Developers 3-1 and 3-2 between the Developer 3-6 which contains silica treated with a silicone oil and untreated titanium dioxide, that Developers 3-1 and 3-2 , each comprising the surface-treated titanium dioxide, are superior in image density at the stages after taking 30,000 copies and after taking 100,000 copies both at high temperature and humidity and at low temperature and humidity as well as in fog level at the stage after taking 100,000 copies both at high temperature and humidity and at low temperature and humidity and in fog level at the stage after taking 30,000 copies at high temperature and humidity.

Further, it can be seen from the comparison between Developers 3-1 and 3-2 and Developer 3-7 which utilizes Carrier 3-B containing no melamine resin particles that Developers 3-1 and 3-2, each utilizing Carrier 3-A containing melamine resin particles, are superior in image density and fog level at the stages after taking 30,000 copies and after taking 100,000 copies both at high temperature and humidity and at low temperature and humidity.

As described below, the fourth invention is explained by way of Examples 25–28 but the fourth invention is not limited thereto.

Example 25

Preparation of Carriers

| Carrier 4-A | Parts by weight |
|---|---|
| Ferrite particles<br>Average particle diameter: 50 μm | 100 |
| Toluene | 16 |
| Styrene/methyl methacrylate copolymer<br>Monomer ratio = 6:4; Mw: 50,000; critical surface tension: 35 dyn/cm | 0.8 |
| Phenolic resin particles<br>Average particle diameter: 0.6 μm; insoluble in toluene | 0.2 |

All of the above-identified components except for the ferrite particles were dispersed by use of a stirrer for 10 minutes to prepare a solution for forming a coating layer. The solution for forming the coating layer and the ferrite particles were placed in a kneader equipped with a vacuum deaerator. The contents were stirred for 30 minutes at 60° C. to distill off the toluene under reduced pressure to thereby form Carrier 4-A comprising ferrite particles and a resin coating layer thereon.

| Carrier 4-B | Parts by weight |
|---|---|
| Ferrite particles<br>Average particle diameter: 50 μm | 100 |
| Toluene | 16 |
| Styrene/methyl methacrylate copolymer<br>Monomer ratio = 6:4; Mw: 50,000; critical surface tension: 35 dyn/cm | 0.6 |
| Nylon resin particles<br>Average particle diameter: 0.4 μm; insoluble in toluene | 0.3 |

All of the above-identified components except for the ferrite particles were dispersed by use of a stirrer for 10 minutes to prepare a solution for forming a coating layer.

The solution for forming the coating layer and the ferrite particles were placed in a kneader equipped with a vacuum deaerator. The contents were stirred for 30 minutes at 60° C. to distill off the toluene under reduced pressure to thereby form Carrier 4-B comprising ferrite particles and a resin coating layer thereon.

| Carrier 4-C | Parts by weight |
|---|---|
| Ferrite particles<br>Average particle diameter: 45 μm | 100 |
| Toluene | 16 |
| Perfluorooctylethyl acrylate/methyl methacrylate copolymer<br>Monomer ratio = 3:7; Mw: 50,000; critical surface tension: 24 dyn/cm | 0.7 |
| Cross linked methyl methacrylate resin particles<br>Average particle diameter: 0.3 μm; insoluble in toluene | 0.2 |

All of the above-identified components except for the ferrite particles were dispersed by use of a stirrer for 10 minutes to prepare a solution for forming a coating layer. The solution for forming the coating layer and the ferrite particles were placed in a kneader equipped with a vacuum deaerator. The contents were stirred for 30 minutes at 60° C. to distill off the toluene under reduced pressure to thereby form Carrier 4-C comprising ferrite particles and having a resin coating layer thereon.

| Carrier 4-D | Parts by weight |
|---|---|
| Ferrite particles<br>Average particle diameter: 45 μm | 100 |
| Toluene | 16 |
| Perfluorooctylethyl acrylate/methyl methacrylate copolymer<br>Monomer ratio = 3:7; Mw: 50,000; critical surface tension: 24 dyn/cm | 0.8 |
| Crosslinked melamine resin particles<br>Average particle diameter: 0.3 μm; insoluble in toluene | 0.2 |

All of the above-identified components except for the ferrite particles were dispersed by use of a stirrer for 10 minutes to prepare a solution for forming a coating layer. The solution for forming the coating layer and the ferrite particles were placed in a kneader equipped with a vacuum deaerator. The contents were stirred for 30 minutes at 60° C. to distill off the toluene under reduced pressure to thereby form Carrier 4-D comprising ferrite particles and having a resin coating layer thereon.

Carrier 4-E

The manufacturing procedure for Carrier 4-A was repeated in the same way except that the phenolic resin particles were not used. In this way Carrier 4-E was obtained.

| Carrier 4-F | Parts by weight |
|---|---|
| Ferrite particles<br>Average particle diameter: 45 μm | 100 |
| Toluene | 14 |
| Perfluorooctylethyl acrylate/methyl methacrylate copolymer<br>Monomer ratio = 3:7; Mw: 50,000; critical surface tension: 24 dyn/cm | 0.5 |
| Methyl methacrylate/dimethylethyl methacrylate copolymer<br>Monomer ratio = 8:2; Mw: 70,000; critical surface tension: 40 dyn/cm | 0.3 |

All of the above-identified components except for the ferrite particles were dispersed by use of a stirrer for 10 minutes to prepare a solution for forming a coating layer. The solution for forming the coating layer and the ferrite particles were placed in a kneader equipped with a vacuum deaerator. The contents were stirred for 30 minutes at 60° C. to distill off the toluene under reduced pressure to thereby form Carrier 4-F comprising ferrite particles and having a resin coating layer thereon.

| Carrier 4-F | Parts by weight |
|---|---|
| Ferrite particles<br>Average particle diameter: 45 μm | 100 |
| Toluene | 16 |
| Perfluorooctylethyl acrylate/methyl methacrylate copolymer<br>Monomer ratio = 3:7; Mw: 50,000; critical surface tension: 24 dyn/cm | 0.8 |

-continued

| Carrier 4-F | Parts by weight |
|---|---|
| Uncrosslinked melamine resin particles<br>Critical surface tension: 65 dyn/cm | 0.2 |

All of the above-identified components except for the ferrite particles were dispersed by use of a stirrer for 10 minutes to prepare a solution for forming a coating layer. The solution for forming the coating layer and the ferrite particles were placed in a kneader equipped with a vacuum deaerator. The contents were stirred for 30 minutes at 60° C. to distill off the toluene under reduced pressure. Then, the temperature was raised to 150° C. and the contents were stirred for 60 minutes to thereby form Carrier 4-G comprising ferrite particles and a resin coating layer thereon including a crossliked melamine resin.

Example 26

Preparation of Toners

| Toner 4-A | % by weight |
|---|---|
| Linear Polyester Resin<br>Synthesized from terephthalic acid/bisphenol A ethylene oxide adduct/cyclohexanedimethanol;<br>Tg = 62° C.; Mn = 4,000; Mw = 35,000; Acid Value = 12; Hydroxyl Value = 25 | 100 |
| Magenta Pigment (C.I. Pigment Red 57) | 3 |

The above-identified components were blended in an extruder, and thereafter were pulverized by means of a jet mill. The resultant powder was treated by a classifier utilizing wind force to obtain particles of magenta toner (color toner) of $d_{50}$=8 μm. The magenta toner particles were blended with 0.4% by weight of silica ("R972" from Nippon Aerosil Co., Ltd.) by means of a Henschel mixer to obtain magenta toner (Toner 4-A).

| Toner 4-B | % by weight |
|---|---|
| Styrene/n-butyl methacrylate<br>Monomer ratio = 70:30; Mn = 7,000; Mw = 40,000 | 94 |
| Carbon black<br>"Morgal L" from Cabot Co. | 6 |

The above - identified components were blended in an extruder, and thereafter were pulverized by means of a mill for bulky powder. The resultant powder was treated by a classifier utilizing wind force to obtain particles of black toner of $d_5$=9 μm. The particles of the black toner were blended with 0.6% by weight of silica ("R972" from Nippon Aerosil Co., Ltd.) by means of a Henschel mixer to obtain black toner (Toner 4-B).

Example 27

Preparation of developers

Each of the aforedescribed Carriers 4-A to 4-D was mixed, with respect to 100 parts by weight thereof, with 7 parts by weight of Toner 4-A by means of a V-shaped blender to obtain Developers 4-1 to 4-4, respectively.

Utilizing these Developers 4-1 to 4-4, copying tests were conducted by means of a copying machine of electrostatic photography (a modified version of "A-Color 30" from Fuji Xerox Co., Ltd.) (having a circumferential speed ratio of a developer carrying roll to a photoreceptor of 0.7). After the 10,000 copying test, at moderate temperature and humidity (22° C., 55% RH), these developers generally provided stabilized images which were free of such defects as fluctuation in the image density and background fogging. Measurements of the charge amounts were conducted at the initial stage, at the stage after taking 1,000 copies and at the stage after taking 10,000 copies.

The results are shown in Table 9.

Further, utilizing these Developers 4-1 to 4-4, copying tests were also conducted by means of by means of a copying machine of electrostatic photography (a modified version of "A-Color630" from Fuji Xerox Co., Ltd.) (having a circumferential speed ratio of a developer carrying roll to a photoreceptor of 1.4). After the 10,000 copying test at moderate temperature and humidity (22° C., 55% RH), these developers generally provided stabilized images which were free of such defects as fluctuation in the image density and background fogging. Measurements of the charge amounts were conducted at the initial stage, at the stage after taking 1,000 copies and at the stage after taking 10,000 copies.

The results are shown in Table 10.

The charge amounts indicate the values obtained by image analysis according to CSG (Charge Spectrography).

In the case where the developers of the fourth invention were used, almost no change in the charge amounts was observed in the circumferential speed ratios of 0.7 and 1.4.

Example 28

Preparation of developers

Each of the aforedescribed Carriers 4-A to 4-D was mixed, with respect to 100 parts by weight thereof, with 7 parts by weight of Toner 4-B by means of a V-shaped blender to obtain Developers 4-5 to 4-8, respectively.

Utilizing these Developers 4-5 to 4-8, copying tests were conducted by means of copying machines of electrostatic photography (each a modified version of "A-Color 630" from Fuji Xerox Co., Ltd.) (having circumferential speed ratios of a developer carrying roll to a photoreceptor of 0.7 and 1.4, respectively ). In the copying test, high-density and high quality images, free from background fogging, were obtained at the initial stage. When 10,000 copies were made in succession thereafter, almost no change in the image quality was observed.

The results are shown in Tables 9 and 10.

Comparative Example 19

Preparation of developers

Each of the aforedescribed Carriers 4-E to 4-G was mixed, with respect to 100 parts by weight thereof, with 7 parts by weight of Toner 4-A by means of a V-shaped blender to obtain Developers 4-9 to 4-11, respectively.

Utilizing these Developers 4-9 to 4-11, copying tests were conducted by means of copying machines of electrostatic photography (a modified version of "A-Color 630" from Fuji Xerox Co., Ltd.) having a circumferential speed ratio of a developer carrying roll to a photoreceptor of 0.7. When 1,000 copies were made at moderate temperature and humidity (22° C., 55% RH), background fogging was observed and stains due to these developers were observed on the interior of the copying machine. Measurements of the charge amounts were conducted at the initial stage and at the stage after taking 1,000 copies.

The results are shown in Table 9.

Further, utilizing these developers, copying tests were also conducted by means of a copying machine of electrostatic photography (a modified version of "A-Color 630" from Fuji Xerox Co., Ltd.) (having a circumferential speed ratio of a developer carrying roll to a photoreceptor of 1.4).

After 10,000 copies were made at moderate temperature and humidity (22° C., 55% RH), the same phenomenon as in the case of the circumferential speed ratio of 0.7 was observed.

The charge amounts indicate the values obtained by image analysis according to CSG (Charge Spectrography).

The results are shown in Table 10.

Comparative Example 20

Utilizing these Developers 4-1 to 4-11, copying tests were conducted by means of copying machines of electrostatic photography (a modified version of "A-Color 630" from Fuji Xerox Co., Ltd.) (having a circumferential speed ratio of a developer carrying roll to a photoreceptor of 0.4). When 10,000 , copies were made at moderate temperature and humidity (22° C., 55% RH), Developers 4-1 to 4-8 generally provided low-density and inferior images although the charge amounts were stabilized, while Developers 4-9 to 4-11 caused background fogging after taking 10,000 copies and stains due to these developer were observed on the interior of the copying machine. Measurements of the charge amounts were conducted at the initial stage, at the stage after taking 1,000 copies and at the stage after taking 10,000 copies.

The results are shown in Table 11.

Comparative Example 21

Utilizing these Developers 4-1 to 4-11, copying tests were conducted by means of copying machines of electrostatic photography (a modified version of "A-Color 630" from Fuji Xerox Co., Ltd.) (having a circumferential speed ratio of a developer carrying roll to a photoreceptor of 2.4). When 10,000 copies were made at moderate temperature and humidity (22° C., 55% RH), a gradual reduction in the charge amount was observed accompanied by background fogging and inferior images resulted. Measurements of the charge amounts were conducted at the initial stage, at the stage after taking 1,000 copies and at the stage after taking 10,000 copies.

The results are shown in Table 12.

TABLE 9

(Circumferential speed ratio; 0.7)

| | | | | Initial stage | | After 3,000 copies | | After 10,000 copies | |
|---|---|---|---|---|---|---|---|---|---|
| | Resin coated carrier | Toner | Developer No. | Charge amount (μC/g) | Background fogging | Charge amount (μC/g) | Background fogging | Charge amount (μC/g) | Background fogging |
| Ex. 27 | 4-A | 4-A | 4-1 | −19.2 | ○ | −20.4 | ○ | −18.1 | ○ |
| | 4-B | 4-A | 4-2 | −28.0 | ○ | −26.8 | ○ | −23.2 | ○ |
| | 4-C | 4-A | 4-3 | −22.4 | ○ | −23.1 | ○ | −20.1 | ○ |
| | 4-D | 4-A | 4-4 | −29.5 | ○ | −27.0 | ○ | −24.0 | ○ |
| Ex. 28 | 4-A | 4-B | 4-5 | −18.5 | ○ | −21.6 | ○ | −19.0 | ○ |
| | 4-B | 4-B | 4-6 | −26.8 | ○ | −25.1 | ○ | −21.1 | ○ |
| | 4-C | 4-B | 4-7 | −22.1 | ○ | −23.4 | ○ | −20.3 | ○ |
| | 4-D | 4-B | 4-8 | −27.0 | ○ | −24.5 | ○ | −20.5 | ○ |
| Comp. | 4-E | 4-A | 4-9 | −19.0 | ○ | −12.1 | x | — | — |
| Ex. 19 | 4-F | 4-A | 4-10 | −29.0 | ○ | −11.4 | x | — | — |
| | 4-G | 4-A | 4-11 | −26.5 | ○ | −14.1 | x | — | — |

TABLE 10

(Circumferential speed ratio; 1.4)

| | | | | Initial stage | | After 3,000 copies | | After 10,000 copies | |
|---|---|---|---|---|---|---|---|---|---|
| | Resin coated carrier | Toner | Developer No. | Charge amount (μC/g) | Background fogging | Charge amount (μC/g) | Background fogging | Charge amount (μC/g) | Background fogging |
| Comp. | 4-A | 4-A | 4-1 | −22.2 | ○ | −20.0 | ○ | −19.2 | ○ |
| Ex. 20 | 4-B | 4-A | 4-2 | −29.0 | ○ | −26.2 | ○ | −23.1 | ○ |
| | 4-C | 4-A | 4-3 | −24.1 | ○ | −23.4 | ○ | −21.2 | ○ |
| | 4-D | 4-A | 4-4 | −29.1 | ○ | −26.0 | ○ | −24.2 | ○ |
| | 4-A | 4-B | 4-5 | −20.7 | ○ | −22.9 | ○ | −20.7 | ○ |
| | 4-B | 4-B | 4-6 | −27.1 | ○ | −25.9 | ○ | −23.2 | ○ |
| | 4-C | 4-B | 4-7 | −24.7 | ○ | −23.0 | ○ | −20.8 | ○ |
| | 4-D | 4-B | 4-8 | −28.1 | ○ | −26.1 | ○ | −22.5 | ○ |
| | 4-E | 4-A | 4-9 | −20.1 | ○ | −10.3 | x | — | — |
| | 4-F | 4-A | 4-10 | −28.1 | ○ | −12.1 | x | — | — |
| | 4-G | 4-A | 4-11 | −27.4 | ○ | −15.0 | x | — | — |

TABLE 11

(Circumferential speed ratio; 0.4)

| | Resin coated carrier | Toner | Developer No. | Initial stage Charge amount (μC/g) | Initial stage Background fogging | After 3,000 copies Charge amount (μC/g) | After 3,000 copies Background fogging | After 10,000 copies Charge amount (μC/g) | After 10,000 copies Background fogging |
|---|---|---|---|---|---|---|---|---|---|
| Ex. 27 | 4-A | 4-A | 4-1 | −21.8 | ○ | −20.1 | ○ | −17.1 | ○* |
| | 4-B | 4-A | 4-2 | −26.3 | ○ | −25.5 | ○ | −20.0 | ○* |
| | 4-C | 4-A | 4-3 | −22.7 | ○ | −21.9 | ○ | −17.9 | ○* |
| | 4-D | 4-A | 4-4 | −26.8 | ○ | −26.1 | ○ | −18.2 | ○* |
| Ex. 28 | 4-A | 4-B | 4-5 | −20.3 | ○ | −20.6 | ○ | −17.2 | ○* |
| | 4-B | 4-B | 4-6 | −25.9 | ○ | −23.1 | ○ | −19.1 | ○* |
| | 4-C | 4-B | 4-7 | −24.1 | ○ | −20.3 | ○ | −17.4 | ○* |
| | 4-D | 4-B | 4-8 | −25.5 | ○ | −22.9 | ○ | −17.2 | ○* |
| Comp. | 4-E | 4-A | 4-9 | −18.9 | ○ | −11.1 | X | — | — |
| Ex. 19 | 4-F | 4-A | 4-10 | −27.1 | ○ | −10.9 | X | — | — |
| | 4-G | 4-A | 4-11 | −23.2 | ○ | −13.1 | X | — | — |

*Low-density and inferior images although the charge amounts were stabilized.

TABLE 12

(Circumferential speed ratio; 2.4)

| | Resin coated carrier | Toner | Developer No. | Initial stage Charge amount (μC/g) | Initial stage Background fogging | After 3,000 copies Charge amount (μC/g) | After 3,000 copies Background fogging | After 10,000 copies Charge amount (μC/g) | After 10,000 copies Background fogging |
|---|---|---|---|---|---|---|---|---|---|
| Comp. | 4-A | 4-A | 4-1 | −21.6 | ○ | −28.4 | ○ | −16.8 | Δ |
| Ex. 21 | 4-B | 4-A | 4-2 | −28.9 | ○ | −28.8 | ○ | −16.1 | Δ |
| | 4-C | 4-A | 4-3 | −23.1 | ○ | −24.1 | ○ | −16.2 | Δ |
| | 4-D | 4-A | 4-4 | −27.4 | ○ | −25.0 | ○ | −16.6 | Δ |
| | 4-A | 4-B | 4-5 | −22.9 | ○ | −26.5 | ○ | −17.1 | Δ |
| | 4-B | 4-B | 4-6 | −27.2 | ○ | −25.0 | ○ | −17.5 | Δ |
| | 4-C | 4-B | 4-7 | −24.5 | ○ | −26.1 | ○ | −17.2 | Δ |
| | 4-D | 4-B | 4-8 | −28.0 | ○ | −27.3 | ○ | −16.7 | Δ |
| | 4-E | 4-A | 4-9 | −22.3 | ○ | −24.1 | ○ | −13.8 | X |
| | 4-F | 4-A | 4-10 | −27.5 | ○ | −25.8 | ○ | −14.4 | X |
| | 4-G | 4-A | 4-11 | −26.6 | ○ | −27.7 | ○ | −14.7 | X |

What is the claimed is:

1. A carrier for developing an electrostatic latent image comprising a core covered with a resin coating layer containing resin particles dispersed in a matrix resin, wherein the resin particles are thermosetting resin particles having a critical surface tension of not less than 20 dyn/cm, and wherein the matrix resin has a critical surface tension of not greater than 35 dyn/cm.

2. A carrier for developing an electrostatic latent image according to claim 1, wherein the thermosetting resin particles have an average particle diameter in the range of 0.1 to 2 μm.

3. A carrier for developing an electrostatic latent image according to claim 1, wherein the thermosetting resin particles are composed of a resin containing a nitrogen atom.

4. A carrier for developing an electrostatic latent image according to claim 1, wherein the average thickness of the resin coating layer is in the range of 0.1 to 10 μm.

5. A carrier for developing an electrostatic latent image according to claim 1, wherein the carrier has an average particle diameter of primary particles thereof in the range of 30 to 150 μm.

6. A carrier for developing an electrostatic latent image according to claim 1, wherein the average diameter (B) of primary particles of the resin particles meets the requirement of (B)≦(A), where (A) represents the average thickness of the resin coating layer.

7. A carrier for developing an electrostatic latent image according to claim 1, wherein the shape factors for core SF1 and SF2 represented by the general equations (1) and (2) meet the requirements represented by the equations (x) and (y):

$$SF1=(\text{maximum diameter})^2\times 100\ \pi/4 \quad (1)$$

$$SF2=(\text{circumferential length of a projected image})^2\times 100/4\pi \quad (2)$$

$$100\leqq SF1\leqq 145 \quad (x)$$

$$100\leqq SF2\leqq 120 \quad (y).$$

8. A carrier for developing an electrostatic latent image according to claim 1, wherein the thermosetting resin is selected from the group consisting of phenolic resins, amino resins, urea/formaldehyde resin, melanine resins, benzoguanamine resins, urea resins, polyamide resins, epoxy resins, dially phthalate resins, unsaturated polyester resins, polyimide resins, alkyd resins, xylene resins, petroleum resins and furan resins.

9. A carrier for developing an electrostatic latent image according to claim 1, wherein the matrix resin is selected from the group consisting of polystyrene, polyethylene, polyvinyl fluoride, polyvinylidene fluoride, polytrifluoroethylene, polytetrafluoroethylene, polyhexafluoropropylene, a copolymer of vinylidene fluoride with an acrylic monomer, a copolymer of vinylidene fluoride with vinyl fluoride, and a terpolymer of tetrafluoroethylene/vinylidene fluoride/unfluorinated monomer.

10. A carrier for developing an electrostatic latent image according to claim 1, wherein the thermosetting resin particles have a critical surface tension ranging from 40 to 70 dyn/cm.

11. A carrier for developing an electrostatic latent image according to claim 1, wherein the matrix resin has a critical surface tension of not greater than 30 dyn/cm.

12. A developer of an electrostatic latent image comprising a carrier and toner, wherein the carrier has a core covered with a resin coating layer containing resin particles dispersed in a matrix resin, wherein the resin particles are thermosetting resin particles having a critical surface tension of not less than 20 dyn/cm, and wherein the matrix resin has a critical surface tension of not greater than 35 dyn/cm.

13. A developer of an electrostatic latent image according to claim 12, wherein the toner is admixed, with respect to 100 parts by weight of the toner, with 0.05–2.0 parts by weight of a hydrophobic silica which surface is treated with a silicone oil, and with 0.05–2.0 parts of a surface-treated titanium dioxide.

14. A developer of an electrostatic latent image according to claim 13, wherein the weight ratio of the silica to the titanium dioxide is in the range of 1:5.5 to 1:20.

15. A developer of an electrostatic latent image according to claim 12, wherein the resin coating layer of the carrier contains resin particles and an electroconductive material dispersed in the matrix resin and wherein the toner comprises a binder resin having a content of THF-in solubles in the range of 1 to 25% by weight based on 100% by weight of the binder resin.

16. A developer of an electrostatic latent image according to claim 12, wherein the thermosetting resin is selected from the group consisting of phenolic resins, amino resins, urea/formaldehyde resin, melanine resins, benzoguanamine resins, urea resins, polyamide resins, epoxy resins, dially phthalate resins, unsaturated polyester resins, polyimide resins, alkyd resins, xylene resins, petroleum resins, and furan resins.

17. A developer of an electrostatic latent image according to claim 12, wherein the matrix resin is selected from the group consisting of polystyrene, polyethylene, polyvinyl fluoride, polyvinylidene fluoride, polytrifluoroethylene, polytetrafluoroethylene, polyhexafluoropropylene, a copolymer of vinylidene fluoride with an acrylic monomer, a copolymer of vinylidene fluoride with vinyl fluoride, and a terpolymer of tetrafluoroethylene/vinylidene fluoride/unfluorinated monomer.

18. A developer of an electrostatic latent image according to claim 12, wherein the thermosetting resin particles have a critical surface tension ranging from 40 to 70 dyn/cm.

19. A developer of an electrostatic latent image according to claim 12, wherein the matrix resin has a critical surface tension of not greater than 30 dyn/cm.

20. An image forming method comprising the steps of developing an electrostatic latent image on an electrostatic latent image substrate by use of a developing substrate with a layer of a developer comprising a carrier and toner, wherein the carrier comprises a core covered with a resin coating layer containing resin particles dispersed in a matrix resin, wherein the resin particles are thermosetting resin particles having a critical surface tension of not less than 20 dyn/cm, and wherein the matrix resin has a critical surface tension of not greater than 35 dyn/cm.

21. An image forming method according to claim 20, wherein the developing substrate and the electrostatic latent image substrate move in the same direction and wherein the circumferential speed ratio of the developing substrate to the electrostatic latent image substrate is in the range of 0.5 to 1.8.

22. An image forming method according to claim 20, wherein the thermosetting resin is selected from the group consisting of phenolic resins, amino resins, urea/formaldehyde resin, melanine resins, benzoguanamine resins, urea resins, polyamide resins, epoxy resins, dially phthalate resins, unsaturated polyester resins, polyimide resins, alkyd resins, xylene resins, petroleum resins, and furan resins.

23. An image forming method according to claim 20, wherein the matrix resin is selected from the group consisting of polystyrene, polyethylene, polyvinyl fluoride, polyvinylidene fluoride, polytrifluoroethylene, polytetrafluoroethylene, polyhexafluoropropylene, a copolymer of vinylidene fluoride with an acrylic monomer, a copolymer of vinylidene fluoride with vinyl fluoride, and a terpolymer of tetrafluoroethylene/vinylidene fluoride/unfluorinated monomer.

24. An image forming method according to claim 20, wherein the thermosetting resin particles have a critical surface tension ranging from 40 to 70 dyn/cm.

25. An image forming method according to claim 20, wherein the matrix resin has a critical surface tension of not greater than 30 dyn/cm.

26. An image forming apparatus to develop an electrostatic latent image on an electrostatic latent image substrate by use of a developing substrate with a layer of a developer, wherein the developer substrate and the electrostatic latent image substrate move in the same direction, wherein the circumferential speed ratio of the developing substrate to the electrostatic latent image substrate is in the range of 0.5 to 1.8, wherein the developing substrate holds a developer comprising a resin-coated carrier and toner, wherein the resin-coated carrier comprises a core covered with a resin coating layer containing resin particles dispersed in a matrix resin, wherein the resin particles are thermosetting resin particles having a critical surface tension of not less than 20 dyn/cm, and wherein the matrix resin has a critical surface tension of not greater than 35dyn/cm.

27. An image forming apparatus according to claim 26, wherein the thermosetting resin is selected from the group consisting of phenolic resins, amino resins, urea/formaldehyde resin, melanine resins, benzoguanamine resins, urea resins, polyamide resins, epoxy resins, dially phthalate resins, unsaturated polyester resins, polyimide resins, alkyd resins, xylene resins, petroleum resins, and furan resins.

28. An image forming apparatus according to claim 26, wherein the matrix resin is selected from the group consisting of polystyrene, polyethylene, polyvinyl fluoride, polyvinylidene fluoride, polytrifluoroethylene, polytetrafluoroethylene, polyhexafluoropropylene, a copolymer of vinylidene fluoride with an acrylic monomer, a copolymer of vinylidene fluoride with vinyl fluoride and a terpolymer of tetrafluoroethylene/vinylidene fluoride/unfluorinated monomer.

29. An image forming apparatus according to claim 26, wherein the thermosetting resin particles have a critical surface tension ranging from 40 to 70 dyn/cm.

30. An image forming apparatus according to claim 26, wherein the matrix resin has a critical surface tension of not greater than 30 dyn/cm.

* * * * *